US005497591A

United States Patent [19]

Nelson

[11] Patent Number: 5,497,591

[45] Date of Patent: Mar. 12, 1996

[54] METAL WALL FRAMING

[75] Inventor: Thomas E. Nelson, Chesterfield, Mo.

[73] Assignee: MiTek Holdings, Inc., Wilmington, Del.

[21] Appl. No.: 180,146

[22] Filed: Jan. 11, 1994

[51] Int. Cl.[6] ..... E04C 2/34

[52] U.S. Cl. ..... 52/481.1; 52/281; 52/289; 52/93.1; 52/745.19; 52/731.7; 52/731.8; 52/731.9; 52/733.2; 52/733.3

[58] Field of Search ..... 52/481.1, 731.4, 52/731.5, 731.7, 731.9, 281, 289, 93.1, 745.19, 281, 289, 731.8, 733.2, 733.3

[56] References Cited

U.S. PATENT DOCUMENTS

| | | | |
|---|---|---|---|
| 2,257,296 | 9/1941 | Goldsmith . | |
| 2,371,921 | 3/1945 | Tucker . | |
| 3,101,817 | 8/1963 | Radek | 52/731.9 X |
| 3,293,813 | 12/1966 | Emmons et al. . | |
| 3,411,254 | 11/1968 | Kessler . | |
| 3,680,271 | 8/1972 | Satchell . | |
| 3,839,839 | 10/1974 | Tillish et al. | 52/481.1 X |
| 3,841,043 | 10/1974 | Zinn | 52/481.1 X |
| 3,845,601 | 11/1974 | Kostecky . | |
| 3,867,047 | 2/1975 | Wightman et al. . | |
| 3,952,462 | 4/1976 | Heise . | |
| 4,478,018 | 10/1984 | Holand . | |
| 4,586,300 | 5/1986 | Mullin | 52/93.1 |
| 4,619,098 | 10/1986 | Taylor | 52/481.1 X |
| 4,809,476 | 3/1989 | Satchell . | |
| 4,854,096 | 8/1989 | Smolik . | |
| 4,991,368 | 2/1991 | Amstutz . | |
| 4,996,811 | 3/1991 | Dull et al. . | |
| 5,022,205 | 6/1991 | Ford, Jr. . | |

*Primary Examiner*—Carl D. Friedman
*Assistant Examiner*—Christopher Todd Kent
*Attorney, Agent, or Firm*—Senninger, Powers, Leavitt & Roedel

[57] ABSTRACT

Metal wall framing sections comprising top, bottom and stud members each formed of sheet metal, the stud members having tongues at the upper and lower ends thereof extending through transverse slots in the top and bottom members, all the tongues except one at the top being bent over on the top member, that one tongue being unbent and extending upwardly from the top member for securement thereto of roof structure, e.g. a roof truss.

27 Claims, 16 Drawing Sheets

163
109
103
111b
101
11
107
141
151
F
115b
105

163
109
103
175
111a
111b
165
177

115b
105
181
171
179
169

269
269
269
269
211b
203
17
17
201
207
207
207
207
241
243
241
243
241
241
243
F
215b
205
213

269
203
269
271
19
19
269
271
269
271
293
293
211a
293
271
295
295
211b
295
209
293
295

301
213
215b
205
301
301
301
299
299
299
299
277
277
277
277
275
275
275
275

205

CP

METAL WALL FRAMING

BRIEF SUMMARY OF THE INVENTION

This invention relates to metal wall framing, and more particularly to metal wall framing sections comprising top and bottom members and studs comprising struts formed of sheet metal, also to struts for use in the framing sections and to methods of fabricating the framing sections.

The invention involves improvements on a prior type of sheet metal wall framing section comprising top and bottom sheet metal channels, the top channel facing down and the bottom channel facing up, with studs or struts each comprising a sheet metal channel spaced at intervals along the length of the top and bottom channels and extending between the channels, each having its upper end extending into the top channel and its lower end extending into the bottom channel, with the web of each stud or strut extending transversely with respect to the top and bottom channels and the flanges of each stud or strut on the inside of the flanges of the top and bottom channels and fastened thereto as by means of self-tapping sheet metal screws driven through the flanges of the top and bottom channel into the flanges of the stud or strut. Such sections are generally fabricated by laying out the top and bottom members and the studs and holding them in position for assembly on a fabrication table, driving self-tapping sheet metal screws down through the upwardly facing flanges of the top and bottom channels into the upper flanges of the studs, then turning the entire section over and driving self-tapping sheet metal screws down through the other flanges (now up) of the top and bottom channels and the other flanges of the studs. The layout and the turning over involve considerable time and labor.

As used in building construction, metal wall framing sections such as above described are generally erected on a slab or other foundation structure, the bottom member of each section being secured to the slab or other foundation structure, and a structure, e.g. a roof structure comprising a plurality of roof trusses, applied to the top members of the sections. It is desirable, and in many localities building codes require, that the roof structure (trusses) be tied down to the foundation structure. The above-described prior wall framing section has no roof tie-down feature incorporated therein, and tying the roof down requires use of extra tie-down components and the labor required for installation of these components.

Among the several objects of the invention may be noted the provision of an improved metal wall framing section of the type described having top and bottom frame members formed of sheet metal and a plurality of stud means formed of sheet metal extending between the top and bottom members spaced at appropriate stud intervals along the length of the top and bottom members, which may be economically and efficiently fabricated with minimum layout and without having to turn the section over, thereby reducing the labor involved in the fabrication of the unit; the provision of such a framing section which, as fabricated and erected on a foundation structure provides for tying down to the foundation structure the trusses of a roof structure or tying down components of other structure such as may be subsequently applied to the top member of the section, the tie-down being effected without the addition of any separate tie-down components other than fasteners such as self-tapping screws; the provision of such a framing section with reduced conduction of heat through the stud means from one face of the section to the other; the provision of such a section in which the stud means is formed to provide relatively wide surfaces at the faces of the section for fastening of cladding, e.g. dry wall on the inside, sheathing on the outside; the provision of such a section of such construction as to facilitate the fastening of dry wall to the inside thereof; the provision of special struts for use in fabricating the sections; and the provision of a method of fabricating the section without turn-over.

In general, a metal wall framing section of this invention comprises spaced apart elongate top and bottom members and a plurality of parallel elongate stud means formed of sheet metal extending between the top and bottom members spaced at intervals along the lengths of said members. Each of said members is formed of sheet metal of such cross-section as to have a web and means for stiffening the web. The web of the bottom member is generally horizontal at the bottom of the section in the erected position of the section. Each stud means comprises at least one strut extending generally vertically between the webs of said members in the erected position of the framing section. The webs of the top and bottom members have sets of slots spaced at said intervals, each set at each interval comprising at least one pair of slots in the web of the top member extending transversely with respect to the top member and at least one slot in the web of the bottom member extending transversely with respect to the bottom member. Each strut has an end edge at one end constituting its upper end generally engaging the bottom face of the web of the top member and a pair of tongues integral therewith extending from said upper end edge through the slots of the respective set of slots in the top member. Each strut has an end edge at its other end constituting its lower end generally engaging the top face of the web of the bottom member and having a tongue integral therewith extending through the slot of the respective set of slots in the bottom member. The tongue at the lower end of each strut is bent over against the bottom face of the web of the bottom member. One of the tongues at the upper end of each strut is bent over against the top face of the web of the top member. The other tongue at the upper end of each strut extends upwardly from the web of the top member for securement thereto of structure (e.g. roof structure) subsequently applied to the top member.

Included in the invention is an elongate sheet metal strut for the stud means of the above-described wall framing section, the strut being adapted to span and interconnect said top and bottom members of the framing section, the strut having one end constituting its upper end and another end constituting its lower end, at least one tongue integrally formed with and extending longitudinally and transversely with respect to the strut from each end thereof, the tongues being adapted to be received in slots formed in said members extending transversely with respect to said members and to be bent over against outer surfaces of the respective members, and an additional tongue integrally formed from the strut extending longitudinally with respect to said strut at its upper end and adapted to be received in a slot in the top member extending transversely with respect to the top member and to remain unbent for securement to a structural member (e.g. a roof truss) supported by the framing section.

In general, the method of this invention for fabricating a wall framing section of the invention as above described comprises positioning a pair of said top and bottom frame members spaced apart approximately the height of the framing section to be fabricated, each member having said transverse slots spaced at said intervals, and positioning a plurality of said stud means between said members spaced at said intervals, each said stud means having at least one tongue at each end integral therewith and extending longitudinally therefrom and an additional tongue integral therewith and extending longitudinally from the end thereof toward the top member. The top and bottom members are moved relatively toward each other thereby to have the tongues of the stud means received in said transverse slots. The tongues extending through the slots in the bottom member are bent against the bottom face of the bottom member and one of the tongues extending from the stud means through a respective slot of the top member is bent against the top face of the top member while leaving the additional tongue extending outwardly (upwardly) from the top member for securement thereto of the structure subsequently applied to the top member whereby the wall framing section may be moved from its position and transported to a location for erection.

Other objects and features will be in part apparent and in part pointed out hereinafter.

BRIEF DESCRIPTION OF THE DRAWINGS

Corresponding reference characters indicate corresponding parts throughout several views of the drawing.

DETAILED DESCRIPTION

Figure 1:
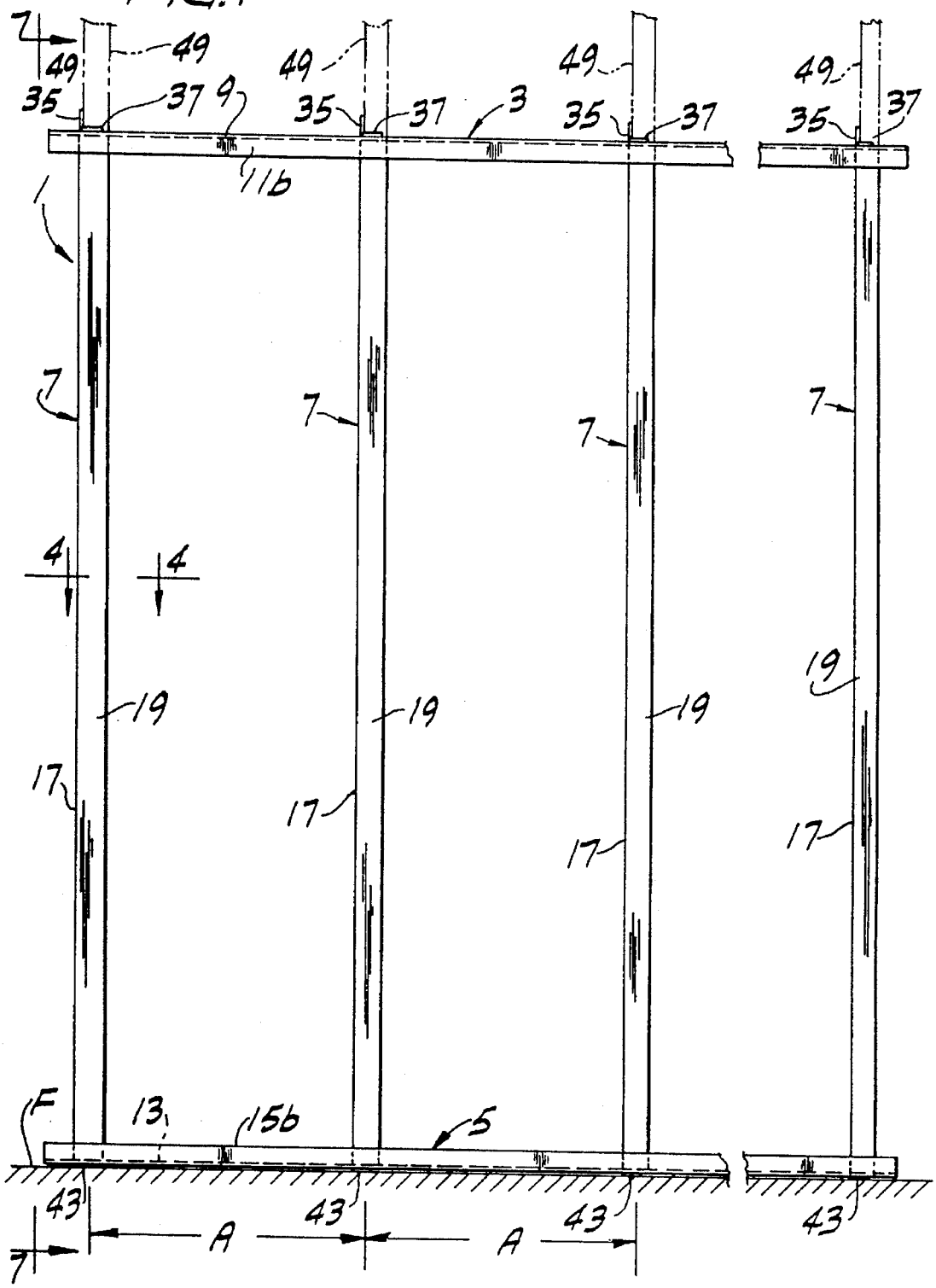
FIG. 1 is a view in elevation of a metal wall framing section of this invention, comprising top and bottom members and stud means of a first type extending therebetween, showing the section as erected on a foundation structure, with parts broken away to reduce the width of the view, and showing in phantom roof trusses bearing on the top member.
Figure 2:
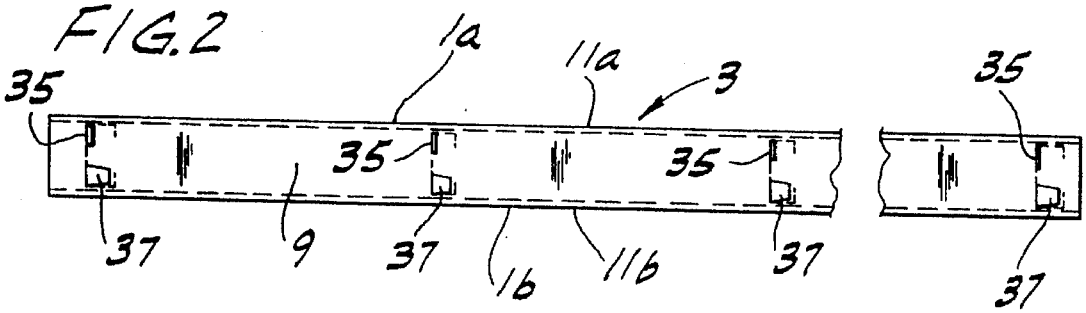
FIG. 2 is a top plan view of FIG. 1.
Figure 3:
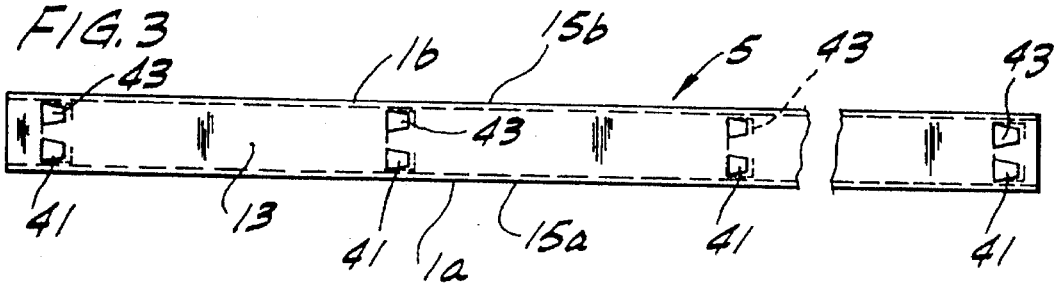
FIG. 3 is a bottom plan view of FIG. 1.
Figure 2A:
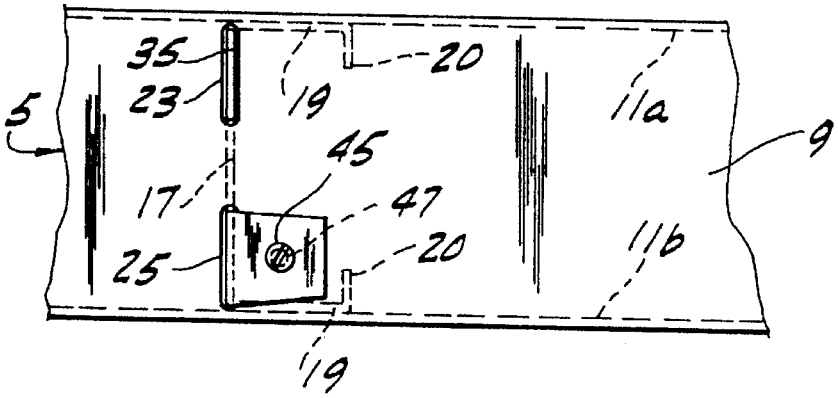
FIG. 2A is an enlarged fragment of FIG. 2 showing a modification.
Figure 3A:
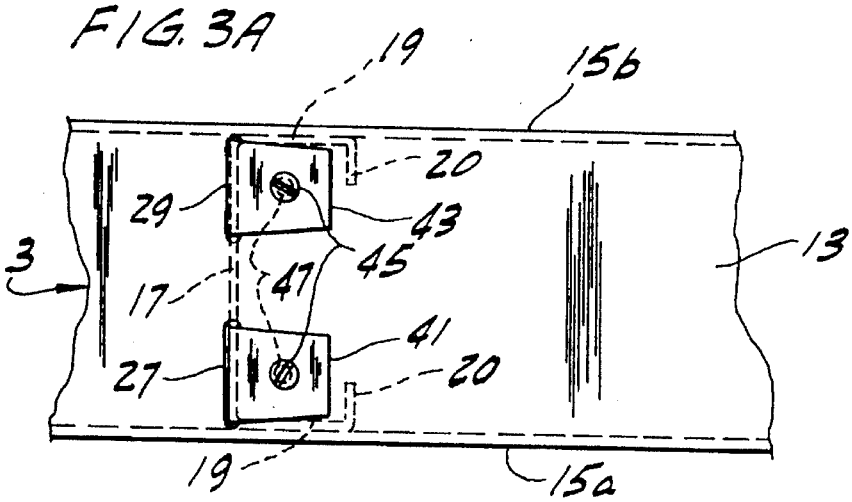
FIG. 3A is an enlarged fragment of FIG. 3 showing a modification.
Figure 4:
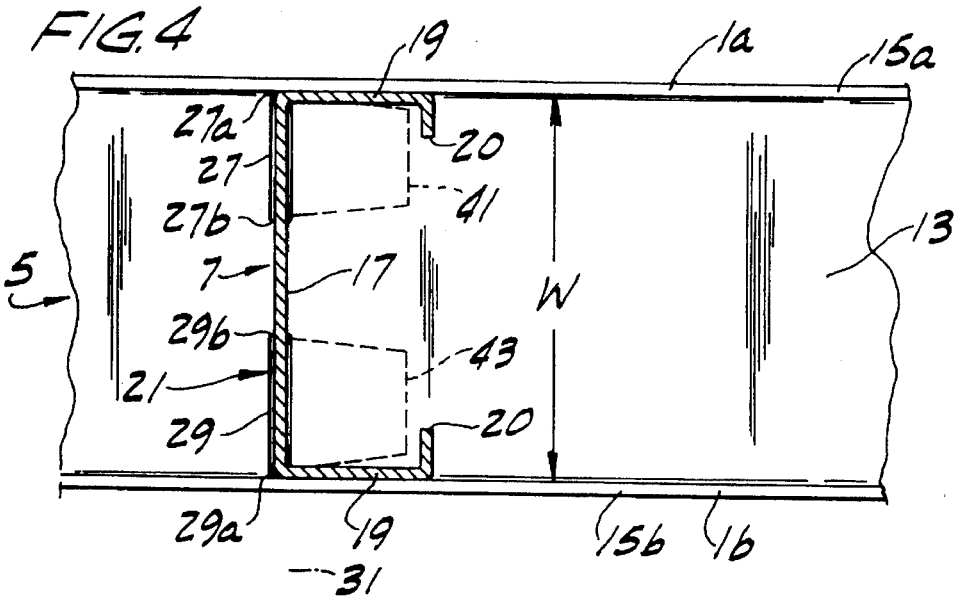
FIG. 4 is enlarged horizontal section on line 4—4 of FIG. 1.
Figure 5:
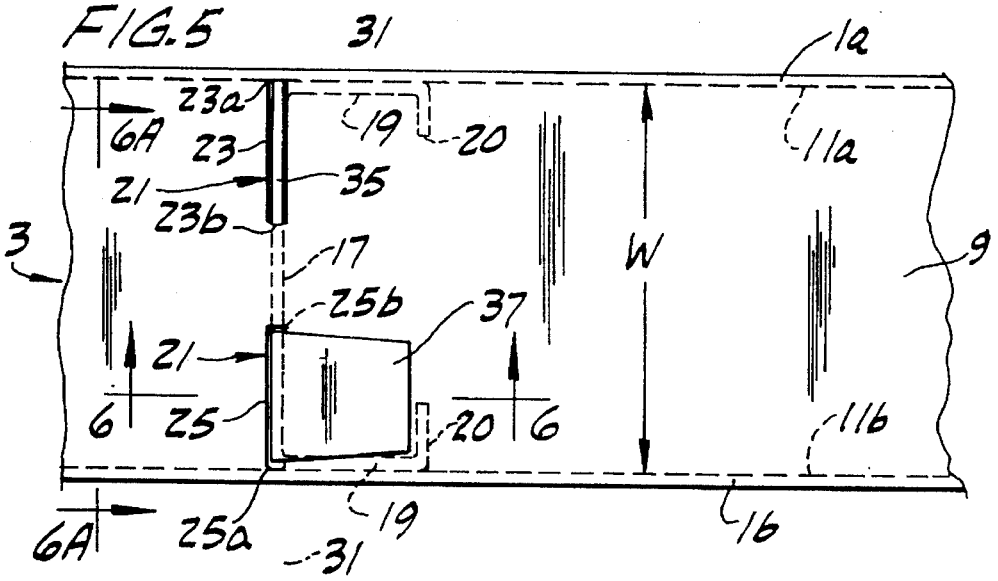
FIG. 5 is an enlarged fragment of FIG. 2.
Figure 5A:
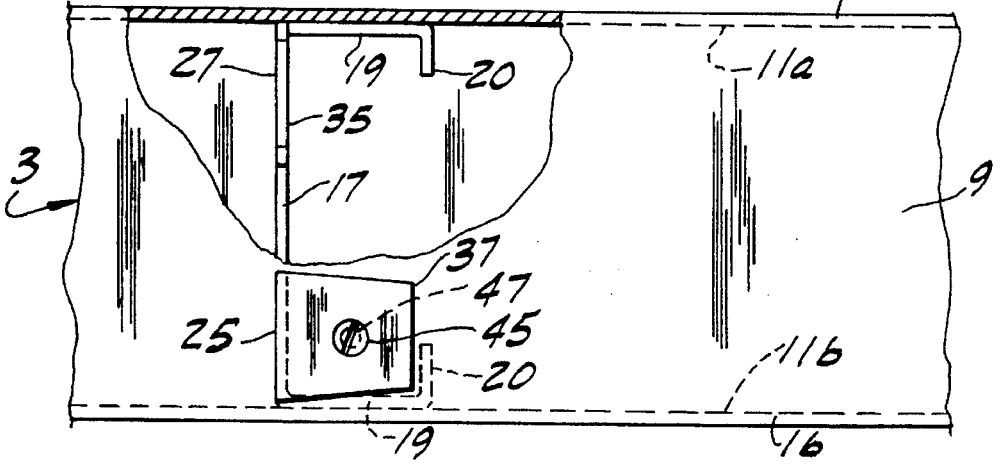
FIG. 5A is a view similar to FIG. 5 with parts broken away and shown in section, and showing the modification according to FIG. 2A.

Referring first to FIGS. 1–7 of the drawings, a metal wall framing section of this invention, designated 1 in its entirety, is shown to comprise spaced apart elongate top and bottom tracks or members 3 and 5 extending parallel to one another and a plurality of parallel elongate stud means each designated 7 formed of sheet metal extending between the top and bottom members generally at right angles thereto spaced at intervals indicated at A in FIG. 1 along the lengths of the top and bottom members. The section 1, which may be fabricated in a plurality of standard lengths and standard heights, is used in constructing walls of a building, with special use for load-bearing outside walls which support roof trusses or other roof structure, though not limited to such use. As erected, the section stands vertical, with the bottom member 5 extending horizontally bearing on suitable supporting structure F, more particularly a slab or other foundation structure. The section may be fabricated in various lengths with as many stud means 7 as needed. The stud means extends vertically upward from the bottom member spaced at appropriate stud intervals, and the top member as herein illustrated extends horizontally over the upper ends of the stud means.

Each of the top and bottom members 3 and 5 is formed of sheet metal (e.g. sheet steel) having a web and means for stiffening the web, the stiffening means of the top member 3 extending downwardly from the web in the erected vertical position of the section 1, the web of the bottom member being generally horizontal at the bottom of the section and the stiffening means of the bottom member extending upwardly from the web in the erected position of the section. More particularly, and preferably, each of the top and bottom members is formed of sheet metal of channel shape in cross section (see particularly FIG. 7), the top member or channel having a web 9 and flanges designated 11*a* and 11*b* extending down from the web at opposite side edges of the web constituting the means for stiffening the web 9, and the bottom member or channel having a web 13 and flanges designated 15*a* and 15*b* extending up from the web at opposite side edges of the web constituting the means for stiffening the web 13.

In the wall framing section 1 shown in FIGS. 1–7, each stud means 7 comprises a single stud member or strut formed of sheet metal (e.g. sheet steel) of channel shape in cross section, having a web 17 and flanges 19 extending at right angles to the web at opposite side edges of the web, with inwardly bent lips 20 at the outer edges of the flanges for stiffening the flanges. The web 17 of each stud means or strut 7 has a width W (the distance between the outside faces of the flanges 19) corresponding generally to the width of the webs 9 and 13 of the top and bottom members, (i.e., the inside width of the top and bottom members between the inside faces of the flanges of the top and bottom members). Each strut is fitted at its upper and lower ends in the top and bottom members 3 and 5 with the web 17 of the strut extending transversely with respect to the top and bottom members and the flanges 19 of the strut on the inside of the flanges 11*a, b* and 15*a, b* of the top and bottom members, with the outside faces of the flanges 19 of the strut generally in engagement with the inside faces of said flanges of the top and bottom members (see particularly FIGS. 4 and 5).

In accordance with this invention, the webs 9 and 13 of the top and bottom members 3 and 5 have a plurality of sets of slots spaced at the aforesaid stud means interval along the lengths of the top and bottom members, each set being designated 21. Each of the sets 21 at each interval comprises a pair of narrow elongate slots 23 and 25 in the web 9 of the top member 3 extending transversely with respect to the top member, and at least one and preferably a pair of narrow elongate slots 27 and 29 in the web 13 of the bottom member 5 extending transversely with respect to the bottom member. The slots 23 and 25 in the web 9 of the top member and slots 27 and 29 in the web 13 of the bottom member are coplanar in a vertical transverse plane 31 of the section 1 (see particularly FIGS. 4 and 5).

The outer ends 23*a* and 25*a* of slots 23 and 25 are located closely adjacent the side flanges 11*a* of the top member 3. These slots extend inwardly from the side flanges 11*a* of the top member 3, their inner ends being indicated at 23*b* and 25*b* in FIG. 5. Similarly, the outer ends 27*a* and 29*a* of the slots 27 and 29 are located closely adjacent the side flanges 15*b* of the bottom member 5 vertically aligned with the outer ends 23*a* and 25*a* of the slots 23 and 25, the inner ends 27*b* and 29*b* of the slots 27 and 29 being vertically aligned with the inner ends 23*b* and 25*b* of slots 23 and 25.

Each stud means or strut 7 has an end edge indicated at 33 (see particularly FIG. 21) at one end constituting its upper end generally engaging the bottom face of the web 9 of the top member 3, further having a pair of tongues 35 and 37 formed integrally therewith extending from said end edge through the slots 23 and 25 of the respective set of slots in the web 9 of the top member 3. Each stud means or strut 7 has an end edge 39 at its other end constituting its lower end generally engaging the top face of the web 13 of the bottom member 5, further having a pair of tongues 41 and 43 formed integrally therewith extending from said end edge 39 through the slots 27 and 29 of the respective set of slots in the web 13 of the bottom member 5. The tongues 35 and 37 at the upper end of the strut 7 are spaced along the upper end edge of the web 17 of the strut for entry in the slots 23 and 25 respectively, and the tongues 41 and 43 at the lower end of the strut are spaced along the lower end edge of the web 17 of the strut for entry in the slots 27 and 29, respectively. The side edges of each of the tongues 35, 37, 41 and 43 are angled so that they converge from the root of the tongue to its free end.

Figure 7:
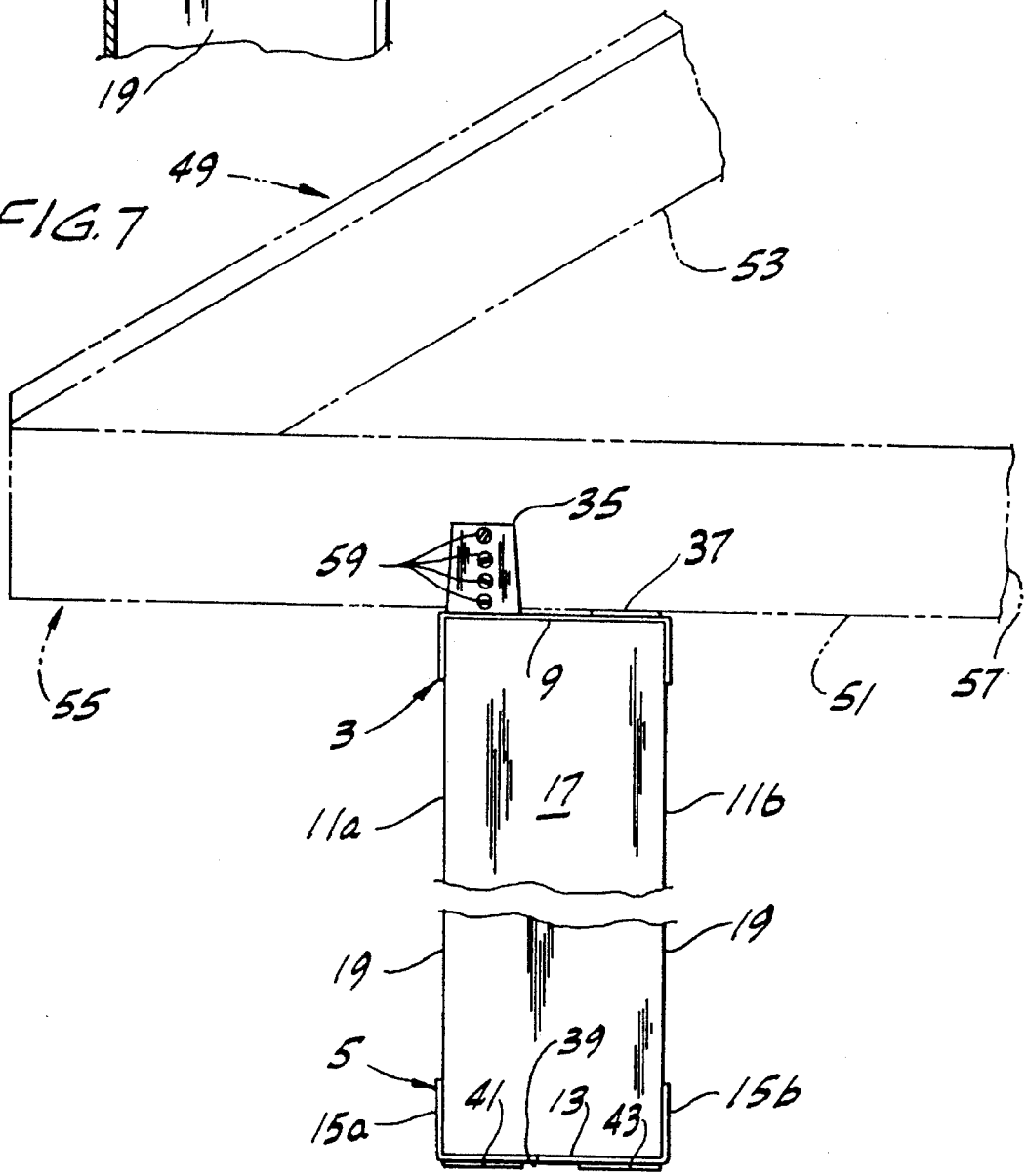
FIG. 7 is a view on line 7—7 of FIG. 1 on a scale intermediate that of FIGS. 1 and 6, with parts broken away to reduce the height of the view, and showing in phantom a roof truss in side elevation.
Figure 8:
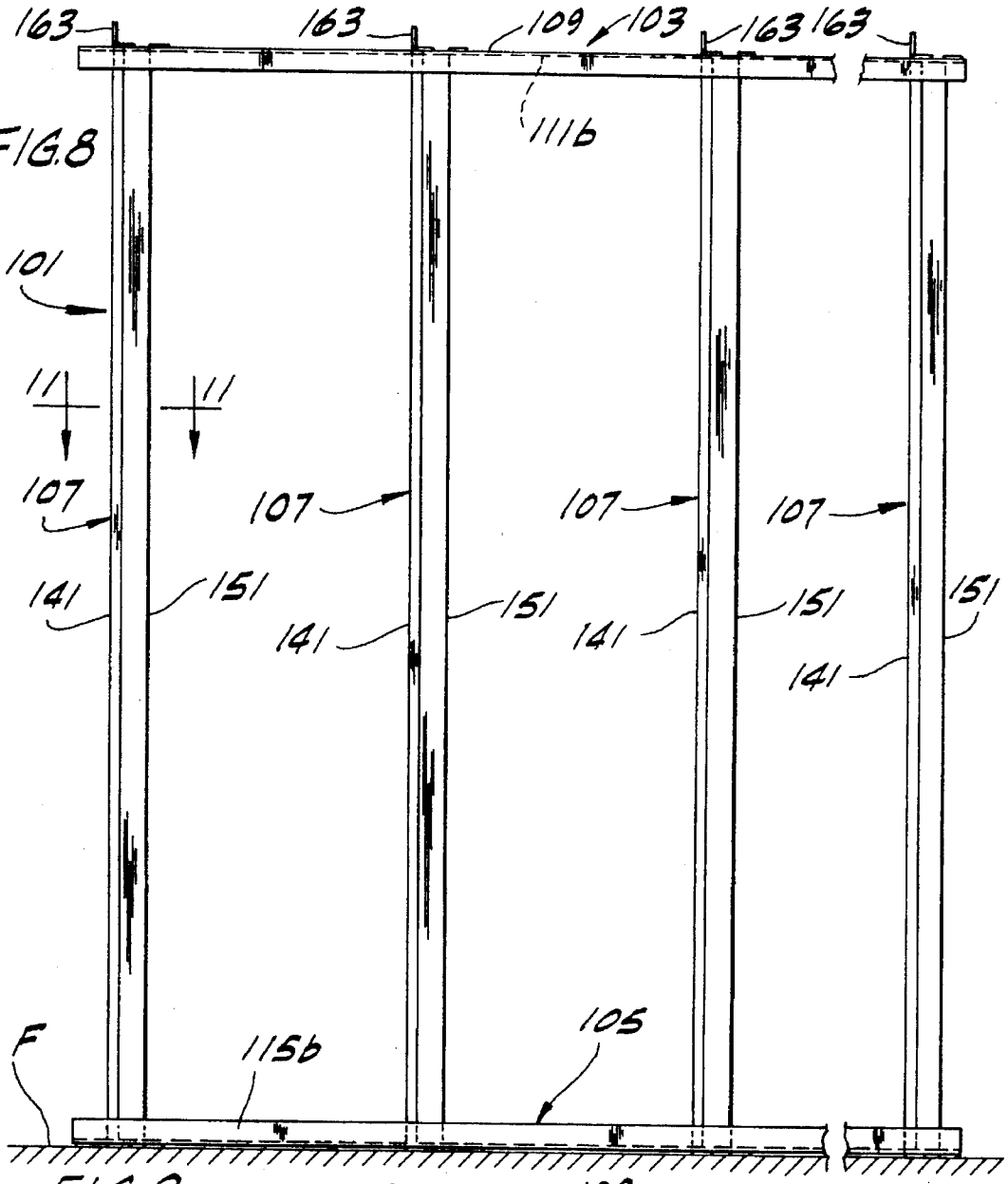
FIG. 8 is a view similar to FIG. 1 showing stud means of a second type extending between the top and bottom members, this type being a double stud comprising first and second struts with space between the struts providing a thermal break.
Figure 9:
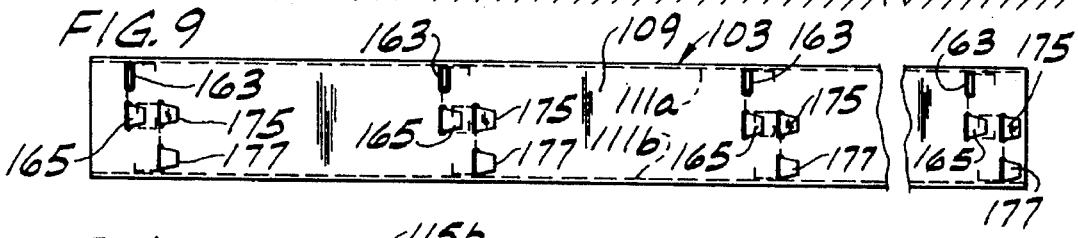
FIG. 9 is a top plan view of FIG. 8.
Figure 10:
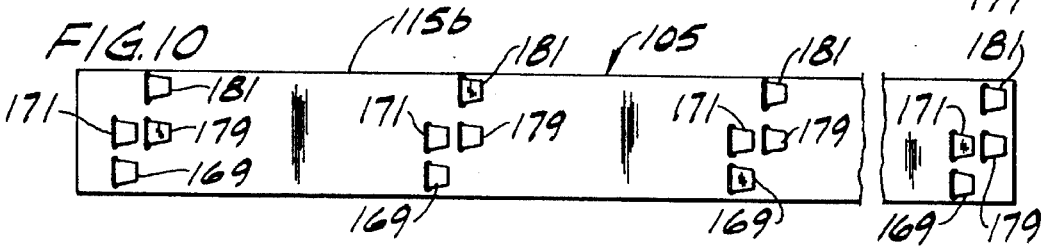
FIG. 10 is a bottom plan view of FIG. 8.
Figure 11:
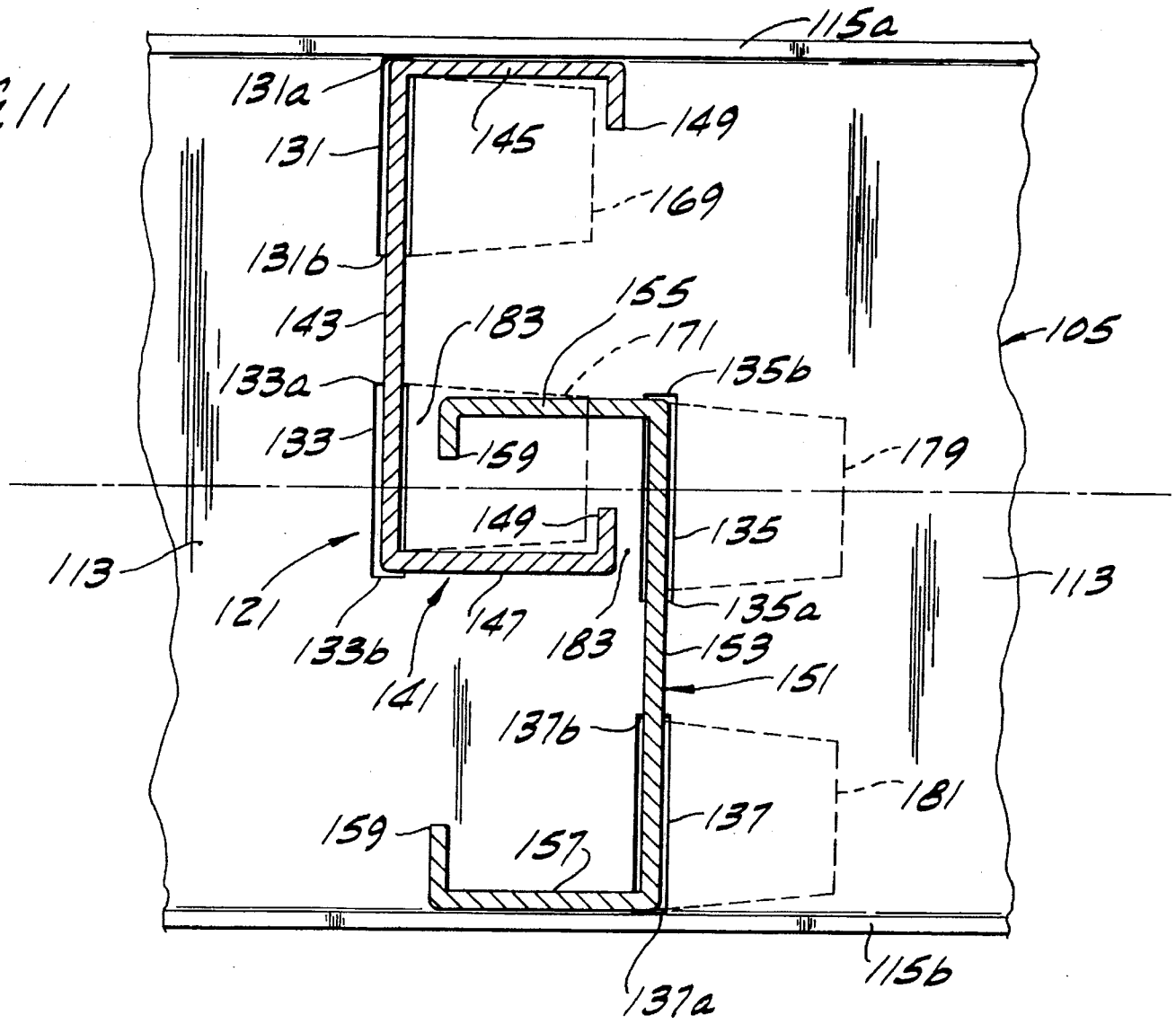
FIG. 11 is an enlarged horizontal section on line 11—11 of FIG. 8.
Figure 12:
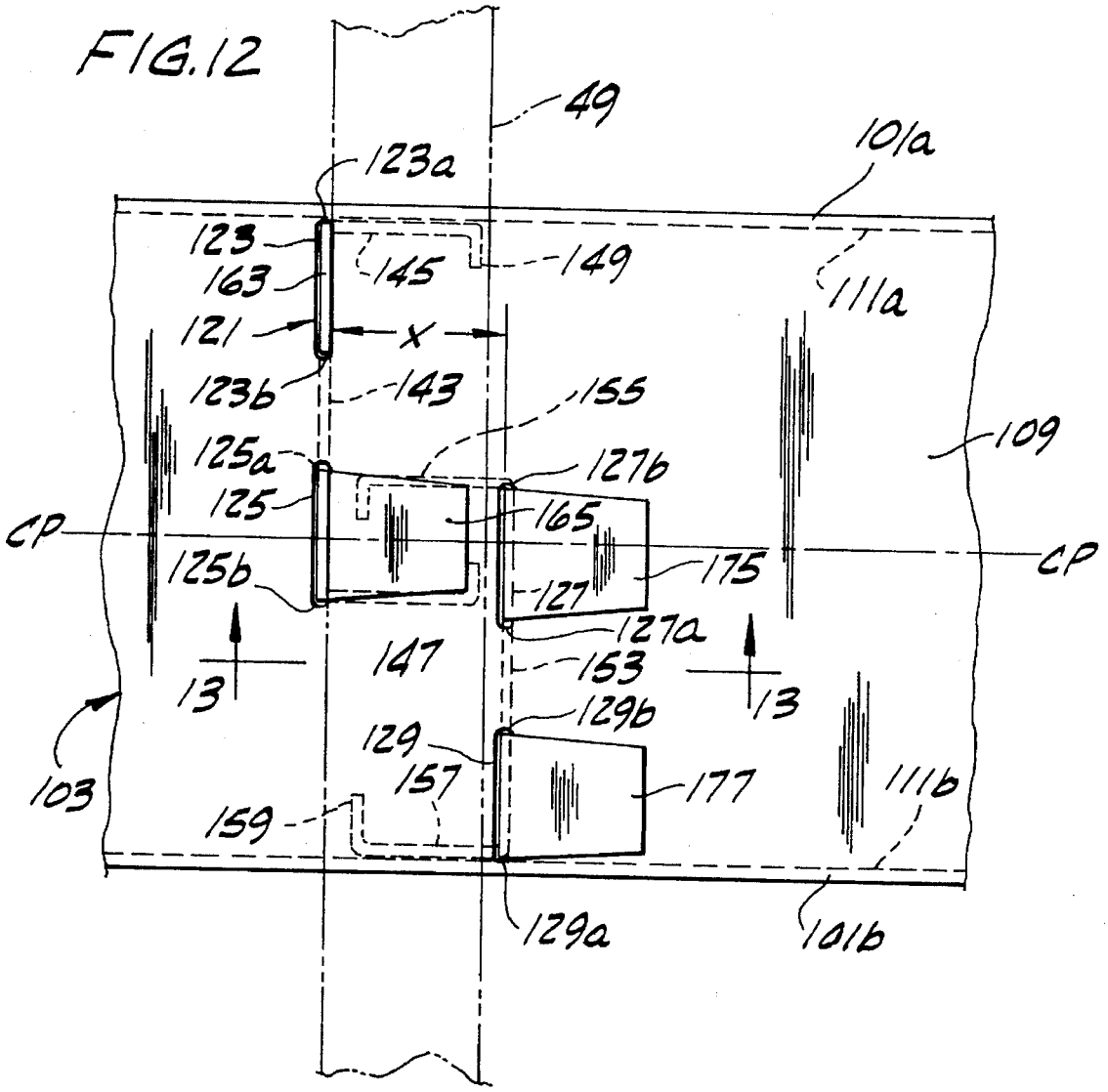
FIG. 12 is an enlarged fragment of FIG. 9.
Figure 13:
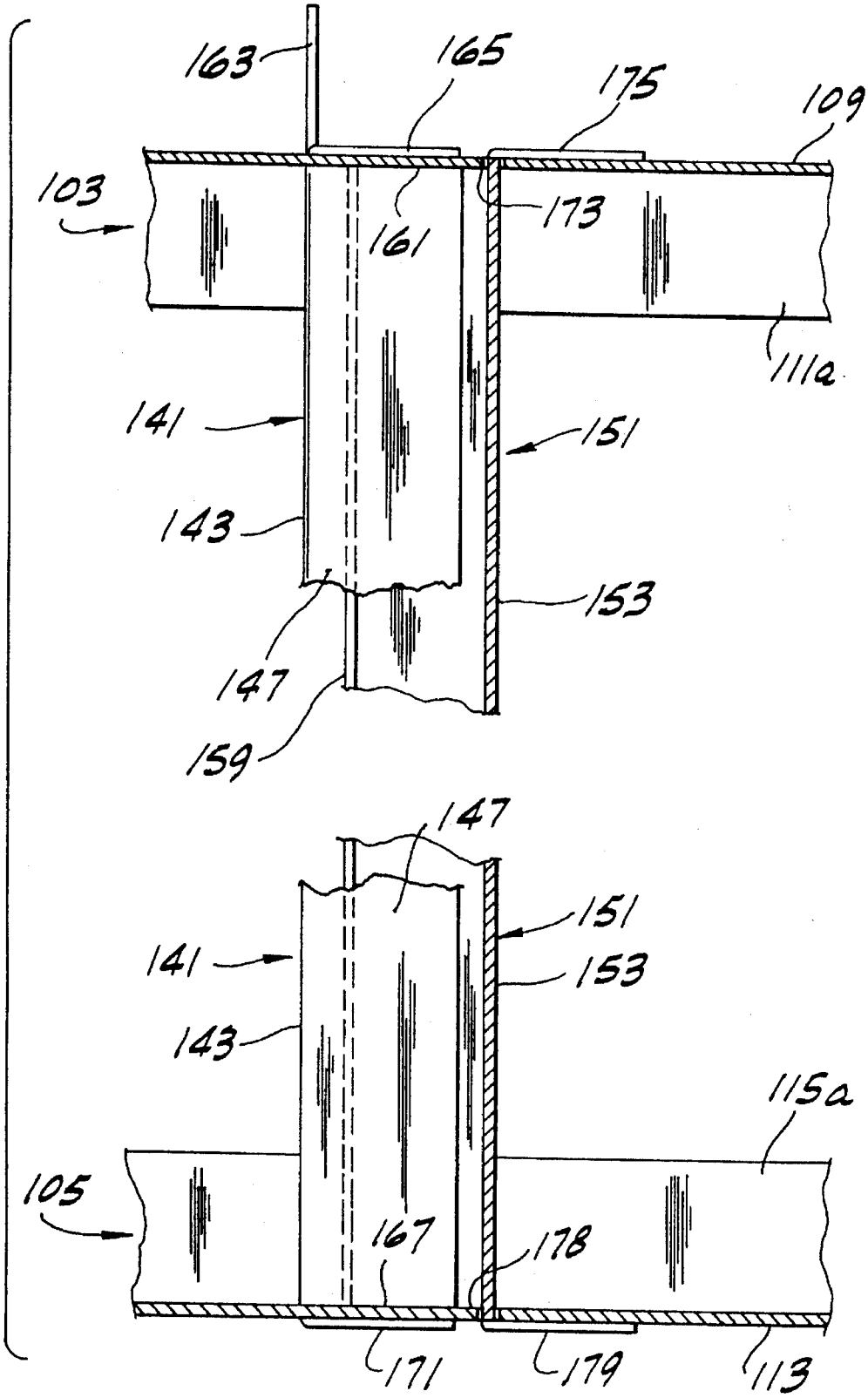
FIG. 13 is a vertical section on line 13—13 of FIG. 12.

Both the tongues 41 and 43 at the lower end of each stud means or strut 7 are bent over against the bottom face of the web 13 of the bottom member 5, Here it is to be understood that the stud means or strut 7 may have only one tongue at its lower end, web 13 of the bottom member 5 then having a single slot for this tongue. One of the tongues at the upper end of each stud means or strut 7, more particularly the tongue 37, is bent over against the top face of the web 9 of the top member 3. The additional tongue 35 at the upper end of each stud means or strut 7 is left unbent extending upwardly from the web 9 of the top member 3 for securement thereto of structure, e.g. a roof truss T as shown in FIG. 7, subsequently applied to the top member 3.

As illustrated in FIGS. 2, 3, 5 and 6, the tongue 37 is simply bent over on the top face of the web 9 of the top member 3, and the tongues 41 and 43 are simply bent over on the bottom face of the web 13 of the bottom member 5 without supplemental securement to these webs. In many instances this is sufficient adequately to hold the top and bottom members 3 and 5 and the stud means or struts 7 in assembly. However, as illustrated in FIGS. 2A, 3A, 5A and 6B, the bent-over tongues 37, 41 and 43 may be fastened to the respective webs by means of self-tapping sheet metal screws such as indicated at 45 in these figures of the drawings, these screws being entered in holes such as indicated at 47 pre-punched in the tongues and driven through the webs 9 and 13, serving to augment the holding of the top and bottom members 3 and 5 and the stud means or struts 7 in assembly with the top and bottom members generally perpendicular to the top and bottom members.

Figure 6:
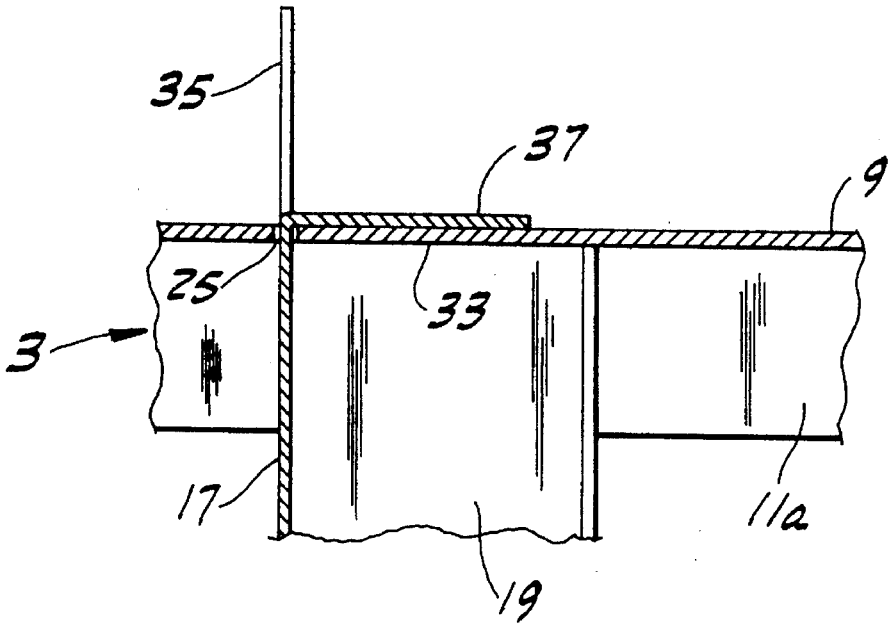
FIG. 6 is a vertical section on line 6—6 of FIG. 5.
Figure 6A:
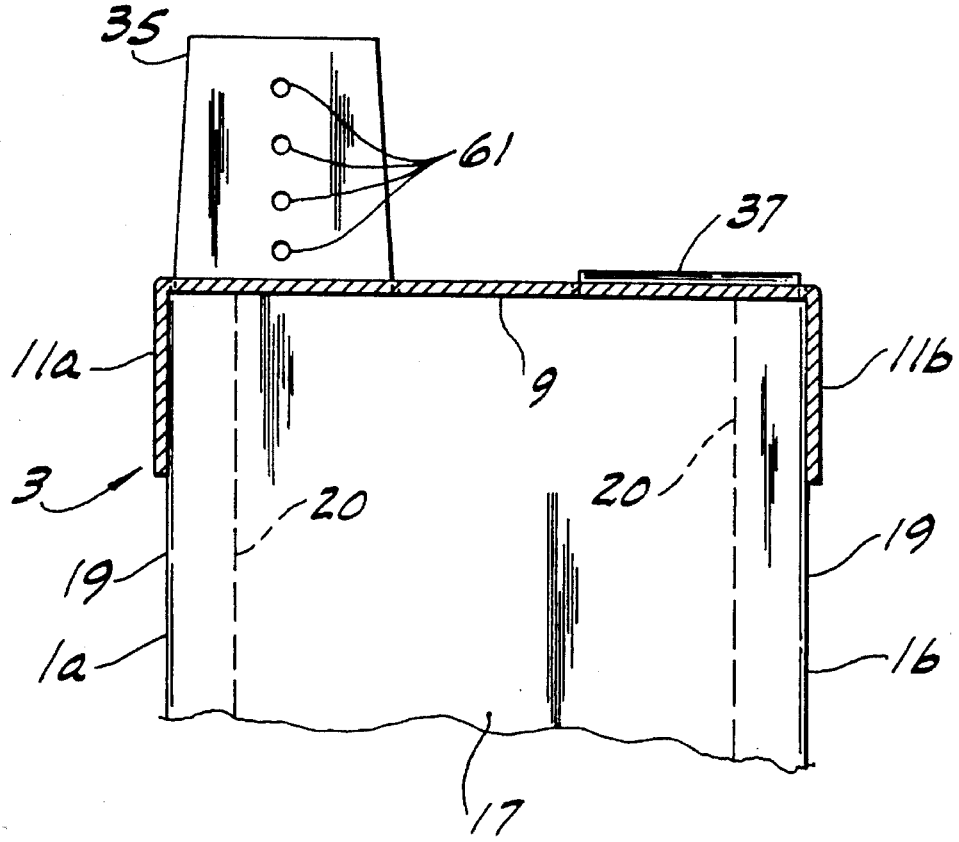
FIG. 6A is an enlarged vertical section on line 6A—6A of FIG. 5.
Figure 6B:
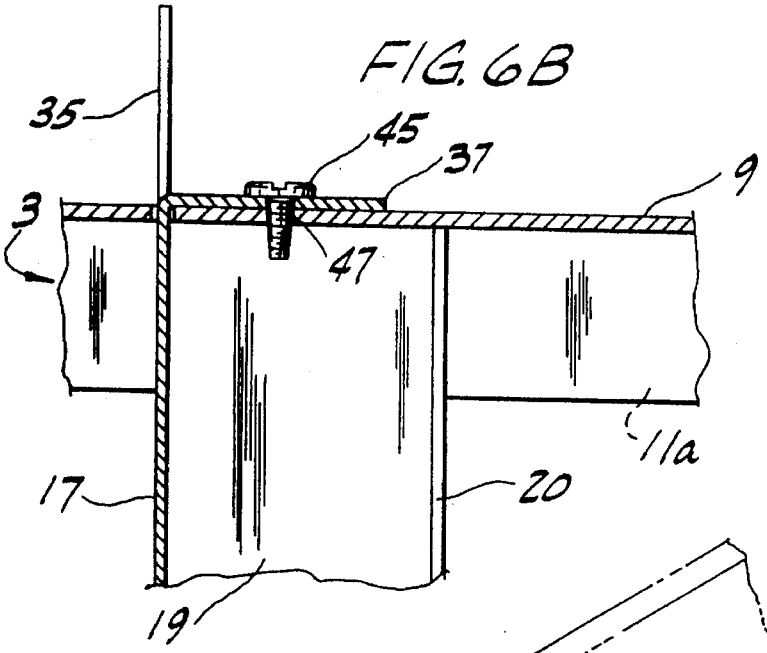
FIG. 6B is a view similar to FIG. 6 showing the modification according to FIGS. 2A and 5A.

In general in erecting a building, two of the wall framing sections 1 are erected spaced apart and extending vertically and parallel to one another on a foundation structure F with the bottom of the sections bearing on the foundation structure and secured thereto as by bolting the web 13 of the bottom member of the section to the foundation structure by anchor bolts embedded in the foundation. Roof trusses such as indicated at 49 in FIGS. 1 and 7 are set in place bearing on the top members 3 of the two sections 1 spanning the latter. Each roof truss 49 may be of the type having a sheet metal bottom chord member 51 and a sheet metal top chord member 53. Each of the trusses is set in place on the two spaced sections 1 (only one of which appears in FIG. 7) extending transversely of the sections 1 with its bottom chord 51 bearing adjacent the heels 55 of the truss on top of top members of the sections at the upper ends of the stud means or struts 7 and with a vertical face 57 of the bottom chord 51 engaged flatwise with one face of the upstanding tongue 35 of the stud means or strut 7, the bottom chord 51 being fastened to the upstanding tongue 35 as by means of self-tapping sheet metal screws 59 driven through the tongue into the bottom chord. As shown in FIG. 7, four screws 59 may be used, and the tongue 35 may have four holes 61 (see FIG. 6A) pre-punched therein receiving the screws. With each of the trusses so secured to the upper ends of the channel-section struts 7, and with the struts 7 extending down to the bottom members 5 of the sections 1 and with the bottom members 5 fastened to the foundation structure F, each truss is tied down to the foundation structure, as may be required by some building codes. With the tongue 35 an integral part of the strut 7, no separate tie-down components are needed, but only screws 59.

The flanges 19 of the stud means or strut 7 of section 1 extend longitudinally in one direction (toward the right as viewed in FIGS. 1–6) with respect to the top and bottom members 3 and 5 of the section with these flanges, or more particularly the outside faces thereof, generally in vertical planes defining faces 1*a*, 1*b* of the section, one of which faces (e.g. 1*a*) may be an outside face and the other an inside face of the building wall. The flanges 19 of the struts are adapted for fastening thereto, as by means of self-tapping sheet metal screws, of cladding subsequently applied to said faces of the section e.g. dry wall on the inside, sheathing on the outside.

Figure 21:
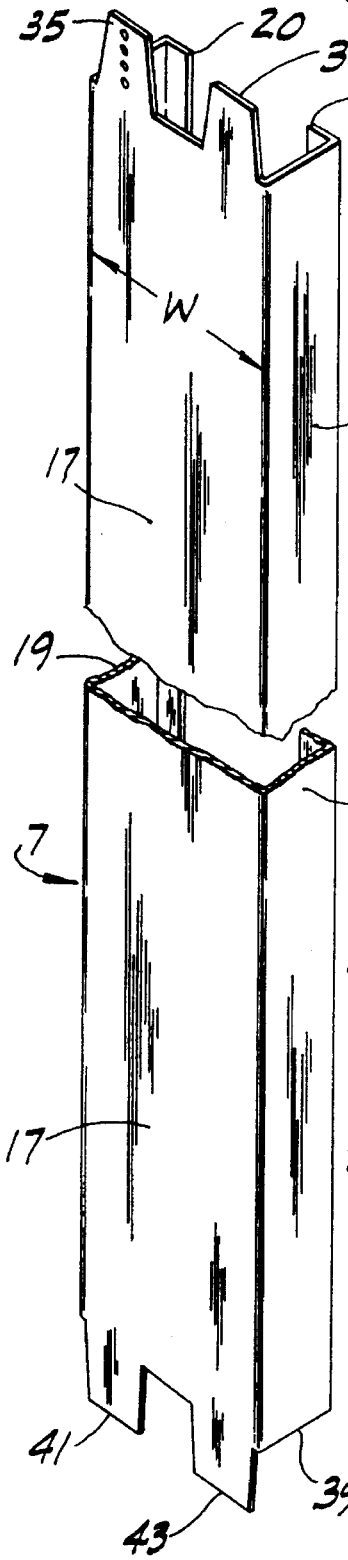
FIG. 21 is a view in perspective, partly broken away, of a strut of the type used in the framing section shown in FIG. 1, and similar to each of the struts used in the framing section of FIG. 8.

The stud means or strut 7 is illustrated per se in FIG. 21 in its as-formed condition prior to its incorporation in a section 1 and before the bending over of the tongues 37, 41 and 43. These tongues, together with the tongue 35, extend endwise from the upper and lower end edges 33 and 39 of the strut coplanar with the web 17 of the strut.

FIGS. 8–13 illustrate a second embodiment of the framing section of this invention, designated in its entirety 101 to distinguish it from the above-described section 1, similar to the latter but differing therefrom in the slotting of the top and bottom members and in that each stud means, designated 107 in its entirety, is a double stud instead of a single stud or strut. The top and bottom members, designated 103 and 105 to distinguish them from members 3 and 5, are formed of sheet metal with the same channel shape in cross section as members 3 and 5. The web of the top member 103 is designated 109 and its flanges 111*a* and 111*b*; the web of the bottom member 105 is designated 113 and its flanges 115*a* and 115*b*. The webs 109 and 113 have a plurality of sets of slots spaced at stud means intervals along the top and bottom members, each set being designated 121 and comprising a first pair of narrow elongate slots 123 and 125 and a second pair of narrow elongate slots 127 and 129 in the web of the top member, and a third pair of narrow elongate slots 131 and 133 and a fourth pair of narrow elongate slots 135 and 137 in the web of the bottom member.

The slots 123 and 125 of the first pair are aligned one with the other on a line extending transversely of the web 109 of the top member, slot 123 having its outer end 123*a* adjacent one of the flanges of the top member 103, more particularly the flange 111*a*, and having a length about one-fifth the width of the top member. The inner end of slot 123 is indicated at 123*b*. Slot 125 is generally of the same length as slot 123 and has its end 125*a* toward the inner end 123*b* of slot 123 spaced from end 123*b* of slot 123 the distance somewhat less than a slot length, thereby having its end 125*a* toward end 123*b* on one side of the longitudinal vertical central plane CP of the webs of the top and bottom members and its end 125*b* on the other side of this plane. The slots 127 and 129 of the second pair of slots are aligned one with the other on a line extending transversely of the web 109 of the top member 103 offset longitudinally of the top member from the line of slots 123 and 125 a distance indicated at X in FIG. 12. Slot 129 has its outer end 129*a* adjacent the other flange, namely flange 111*b*, of the top member 103, also having a length about one-fifth the width of the top member. The inner end of slot 129 is indicated at 129*b*. Slot 127 is generally of the same length as slot 129 and has its end 127*a* toward the inner end 129*b* of slot 129 spaced from end 129*b* of slot 129 a distance somewhat less than the slot length, thereby having its end 127*b* on the said one side of the plane CP and its other end 127*a* on said other side of said plane.

The slots 131 and 133 of the third pair (in web 113 of the bottom member 105) are aligned one with the other on a line extending transversely of the web 113 of the bottom member 105, slot 131 having its outer end 131*a* adjacent flange 115*a* of the bottom member 105 and being of the same length as and directly below and paired with slot 123. The inner end of slot 131 is indicated at 131*b*. Slot 133 is of the same length as slot 131 (and the other slots) and has its end 133*a* toward the inner end 131*b* of slot 131 spaced from end 131*b* of slot 131 a distance somewhat less than the slot length. Slot 133 is directly below and paired with slot 125. Its other end is designated 133*b*. The slots 135 and 137 of the fourth pair of slots are of the same length as and directly below and paired with slots 127 and 129, respectively, their ends being indicated at 135*a* and 135*b*, 137*a* and 137*b*.

As noted above, each stud means 107 is a double stud comprising two struts. Each of these struts is formed of sheet metal of C-shape or channel shape in cross section (see particularly FIG. 11). A first of these struts, designated 141, is shown as having a flat web 143 and first and second flanges 145 and 147 extending at right angles to the web with flange-stiffening lips each designated 149 at the edges of the flanges. The second of these struts, designated 151, is identical to the first, having a flat web 153 and first and second flanges 155 and 157 extending at right angles to the web and lips 159. Each of the struts 141 and 151 has a width (from flange-to-flange) somewhat greater than half the width of the top and bottom members 103 and 105.

Each strut 141 has an end edge indicated at 161 (see FIG. 13) at one end constituting its upper end generally engaging the bottom face of the web 109 of the top member 103, further having a pair of integral tongues 163 and 165 extending from said end edge through the slots 123 and 125 of the respective set of slots in the web 109 of the top member 103. Each strut 141 has an end edge 167 at its other end constituting its lower end generally engaging the top face of the web 113 of the bottom member 105, further having a pair of tongues 169 and 171 extending from said lower end edge 167 through the slots 131 and 133 of the respective set of slots in the web 113 of the bottom member 105. The tongues 163 and 165 at the upper end of the strut 141 are spaced along the upper end edge of the strut for entry in the slots 123 and 125 respectively, and the tongues 169 and 171 at the lower end of the strut are spaced along the lower end edge of the strut for entry in the slots 131 and 133, respectively.

Each strut 151 has an end edge indicated at 173 (FIG. 13) at one end constituting its upper end generally engaging the bottom face of the web 109 of the top member 103, further having a second pair of integral tongues 175 and 177 (FIG. 12) extending from its said upper end edge through the slots 127 and 129 of the respective set of slots in the web 109 of the top member 103. Each strut 151 has an end edge 178 at its other end constituting its lower end generally engaging the top face of the web 113 of the bottom member 105, further having a pair of tongues 179 and 181 extending from its said lower end edge through the slots 135 and 137 of the respective set of slots in the web 113 of the bottom member 105. The tongues 175 and 177 at the upper end of the strut 151 are spaced along the upper end edge of the strut for entry in the slots 127 and 129, respectively, and the tongues 179 and 181 at the lower end of the strut are spaced along the lower end edge of the strut for entry in the slots 135 and 137, respectively.

Each first strut 141 has its web 143 extending in a vertical plane transverse to the top and bottom members 103 and 105 and has its flange 145 extending at right angles to the web 143 longitudinally in one direction from the longitudinal edge of the web 143 at the outer end of the slots 123 and 131 on the inside of flanges 111*a* and 115*a* of the top and bottom members. Thus, the flange 145 is located in a plane defining one face 101*a* (the outside face) of the section 101. Each second strut 151 of each pair of struts 141 and 151 is juxtaposed with the first strut 141 transversely with respect to the top and bottom members 103 and 105 having its web 153 extending in a vertical plane transverse to the top and bottom members and its flange 157 extending at right angles to the web 153 from a longitudinal edge of the web located opposite the flange 147 of the first strut 141 on the inside of flanges 111*b* and 115*b* in a plane defining the other face 101*b* (the inside face) of the section 101. Thus, flanges 145 and 157 of the struts are adapted for fastening thereto cladding subsequently applied to the faces of the section. The tongues 165, 175, 177 are bent over against the top face of the web 109 of the top member 103. The tongue 163 is left unbent for securement to a structural member such as truss 49 in the same manner as illustrated in FIG. 7. The tongue 163 may have screw holes pre-punched thereon as noted above for tongue 41.

The struts 141 and 151 are identical, each being generally C-shaped or of channel shape in cross section, each being of the same general conformation as the strut 7 as illustrated in FIG. 21. They are arranged opening in opposite directions, strut 141 opening toward the right and strut 151 opening toward the left as viewed in FIG. 11. The slots 123 and 125 are spaced or offset longitudinally with respect to the top member 103 from slots 127 and 129, and slots 131 and 133 are spaced longitudinally with respect to the bottom member 105 from slots 135 and 137 the distance X (see FIG. 12), which is somewhat greater than the width of the flanges of the struts. The flange 147 of the strut 141 extends between the lips 159 of and into the space in the channel-section strut 151, being spaced from the edge of the lip 159 on flange 155 of the strut 151, the lip 149 on flange 147 of the strut 141 being spaced from the web 153 of strut 151, the flange 155 of the strut 151 extending into the space in the channel-section strut 141 spaced from the edge of the lip 149 on flange 147 and spaced from its web 143 of strut 141 so as to provide a thermal break indicated at 183 between the two struts.

The top and bottom tracks or members 103 and 105 and the struts 141 and 151 may all be formed of sheet steel of the same gauge, e.g. 20 gauge. It will be understood, however, that the strut, e.g. strut 151 toward the face 101*b* of the section 101 that is to be on the inside in the building as erected and to have dry wall applied thereto may be of thinner gauge, e.g. 25 gauge, than the top and bottom members and struts 141 to make it easier to drive self-tapping sheet metal screws through the dry wall into the flanges 157 of the struts 151 at said inside face.

FIGS. 14–20 illustrate a third embodiment, presently the preferred embodiment, of the framing section of this invention, designated 201 in its entirety to distinguish it from sections 1 and 101. It is similar to the section 101 in having double studs but differs therefrom in the slotting of the top and bottom members and in the cross-section of the struts. The top and bottom members, designated 203 and 205 to distinguish them from members 3 and 5 and 103 and 105, are formed of sheet metal with the same channel shape in cross section as members 3 and 5 and 103 and 105. The double studs are each designated 207. The web of the top member is designated 209 and its flanges 211*a* and 211*b*; the web of the bottom member 205 is designated 213 and its flanges 215*a* and 215*b*. The webs 209 and 213 have a plurality of sets of slots spaced at stud intervals along the length of the top and bottom members, each set being designated 221 and comprising four narrow elongate slots 223, 225, 227 and 229 in the web 209 of the top member 205 and four corresponding narrow elongate slots 231, 233, 235 and 237 in the web 213 of the bottom member 203. Each slot extends transversely of the respective web, each having a length generally the same as the length of the slots in the top and bottom members of section 101 (viz. about one-fifth the width of the top and bottom members). Slots 223 and 231 are paired, coplanar in a first vertical transverse plane P1 of the section 201 (see FIGS. 17 and 18). Slots 225 and 233 are paired, coplanar in a second vertical transverse plane P2 of the section 201. Slots 227 and 235 are paired, coplanar in a third vertical plane P3 of section 201. And slots 229 and 237 are paired, coplanar in a fourth vertical plane P4 of section 201. These planes are offset from one another longitudinally with respect to the top and bottom members. The paired slots 223 and 231 are located on one side of the central vertical plane CP of section 201 with the outer ends 223*a* and 231*a* of these slots adjacent flanges 211*a*, 215*a*, respectively. The inner ends of slots 223 and 231 are indicated at 223*b* and 231*b*. The ends of slots 225, 227, 229 and 233, 235, 237 are indicated at 225*a*, 225*b*, 227*a*, 227*b*, 229*a*, 229*b* and 233*a*, 233*b*, 235*a*, 235*b*, 237*a*, 237*b*. The slots 225 and 233 are offset both longitudinally and laterally with respect to the webs 209, 213 of the top and bottom members from slots 223 and 231, lying on the same side of the plane CP as slots 223 and 231. The slots 227 and 235 are offset a relatively small distance longitudinally with respect to the webs 209, 213 from the plane P2 of slots 225 and 233, and are offset laterally with respect to the webs from slots 225 and 233, lying on the other side of the plane CP. The slots 239 and 237 are offset longitudinally with respect to the webs 209, 213 a distance generally corresponding to the offset of slots 223, 225 and 231, 233, and offset laterally with respect to the webs, the outer ends 229*a* and 231*a* of slots 229 and 237 lying adjacent the other flanges 211*b*, 215*b* of the top and bottom members.

Figure 22:
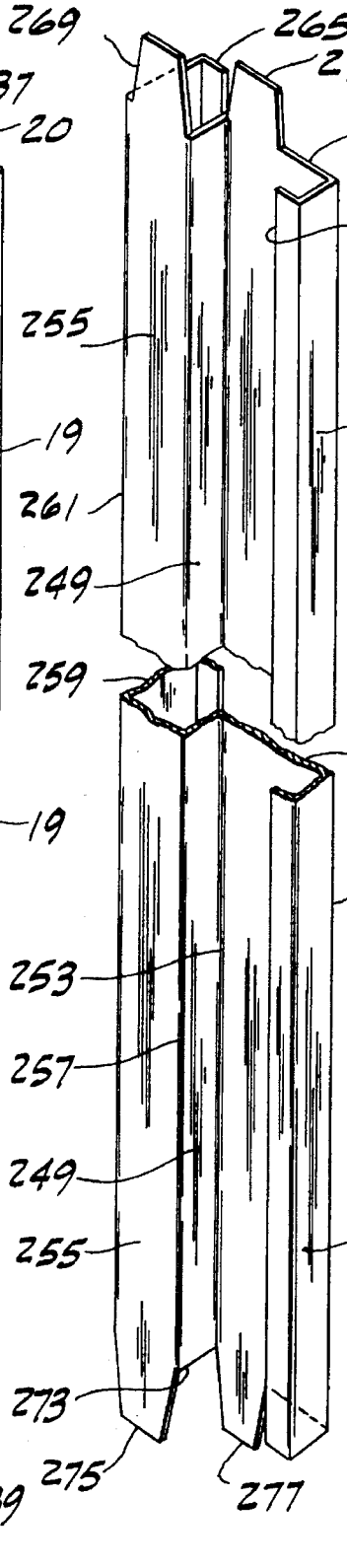
FIG. 22 is a view in perspective, partly broken away, of a first strut used in the framing section of FIG. 14.

As noted above, each stud means 207 is a double stud comprising two struts 241 and 243. Each first strut 241, illustrated per se in FIG. 22, is formed with such a shape in cross-section as to have a first web 245 which extends in a vertical plane transverse to the top and bottom members, first and second flanges 247 and 249 extending at right angles to the said first web 245 in one direction from the longitudinal edges 251 and 253 of the said first web 245, a second web 255 extending laterally outwardly from the outer longitudinal edge 257 of the second flange 249, and a third flange 259 extending back at right angles to the said second web 255 from the outer longitudinal edge 261 of said second web 255. The flanges 247 and 259 have lips indicated at 263 and 265. Each first strut has an upper end edge indicated at 267 and tongues 269 and 271 integral with the strut extending out from the said second and first webs 255 and 245 at said upper end edge. Each first strut has a lower end edge indicated at 273 and tongues 275 and 277 integral with the strut extending from the said second and first webs 255 and 245 at said lower end edge. The tongues 269 and 271 at the upper end of the strut 241 are dimensioned and offset one from the other in accordance with the dimensions and offset of slots 223 and 225 for entry in these slots, respectively. The tongues 275 and 277 at the lower end of the strut are dimensioned and offset one from another in accordance with the dimensions and offset of slots 231 and 233 for entry in these slots, respectively.

Figure 23:
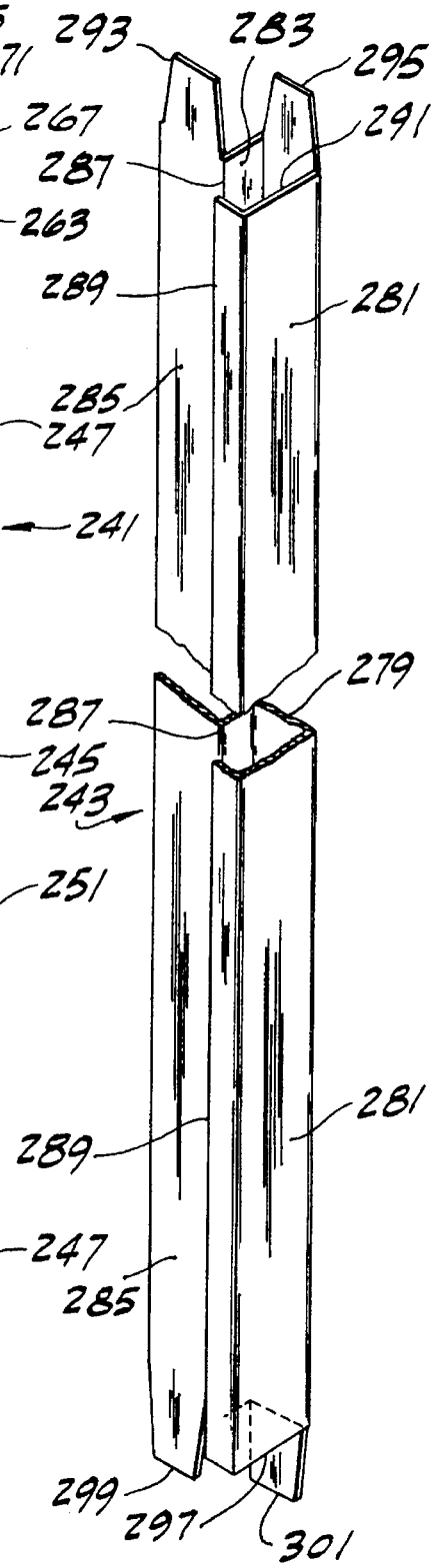
FIG. 23 is a view in perspective, partly broken away, of a second strut used in the framing section of FIG. 14.

Each second strut 243, illustrated per se in FIG. 23, is formed with such a shape in cross-section as to have a first web 279 which extends in a vertical plane transverse to the top and bottom members, first and second flanges 281 and 283 extending at right angles to said first web in one direction from said first web, and a second web 285 extending laterally outwardly from the outer longitudinal edge 287 of the second flange. The flange 281 has a lip indicated at 289. Each second strut has an upper end edge indicated at 291 and tongues 293 and 295 integral therewith extending out from the webs 285 and 279 at said upper end edge. The tongues 293 and 295 are dimensioned and offset one from the other in accordance with the dimensions and offset of slots 227 and 229 for entry in these slots, respectively. Each second strut has a lower end edge indicated at 297 and tongues 299 and 301 integral therewith extending from said second and first webs 285 and 279. The tongues 299 and 301 at the lower end of the strut 243 are dimensioned and offset one from the other in accordance with the dimensions and offset of slots 235 and 237 for entry in these slots, respectively.

Each pair of struts 241 and 243 is assembled with the top and bottom members 203 and 205 extending between said members, with the upper end edges 267 and 291 of the struts engaging the bottom face of the web 213 of the top member 205, with the lower end edges 273 and 297 of the struts engaging the top face of the web 213 of the bottom member, with tongues 269 and 271 at the upper end of strut 241 extending through the slots 223 and 225 in the web of the top member, with tongues 275 and 277 at the lower end of the strut 241 extending through the slots 231 and 233 in the web of the bottom member, with tongues 293 and 295 at the upper end of strut 243 extending through the slots 227 and 229 in the web of the top member, and with tongues 299 and 301 at the lower end of the strut 243 extending through the slots 235 and 237 in the web of the bottom member. The outside face of flange 259 of strut 241 at its upper end is generally engaged face-to-face with the inside face of the flange 211*a* of the top member and the outside face of the flange 259 at its lower end is generally engaged face-to-face with the inside face of the flange 215*a* of the bottom member. Thus, flanges 259 of the several struts 241 are generally coplanar in a plane defining one face (face 201*a*) of the section 201. The outside face of flange 281 of strut 243 at its upper end is generally engaged face-to-face with the inside face of the flange 211*b* of the top member and the outside face of flange 281 of strut 243 at its lower end is generally engaged face-to-face with the inside face of the flange 215*b* of the bottom member. Thus, flanges 281 of the struts 243 are generally coplanar in a plane defining the other face (face 201*b*) of the section 201. Flanges 259 and 281 are adapted for fastening thereto cladding subsequently applied to the faces of section 201.

Each second strut 243 of each pair of struts 241 and 243 is juxtaposed with the first strut 241 transversely with respect to the top and bottom members 203 and 205 with web 245 of strut 241 in plane P2 spaced from web 285 of strut 243 at 303 so as to provide a thermal break 303 between the two struts. The tongues 269 and 271 at the upper ends of the struts 241 extend through the slots 223, 225, and the tongues 275 and 277 at the lower ends of the 241 struts extend through the slots 231 and 233. The tongues 293 and 295 at the upper ends of the struts 243 extend through the slots 227 and 229, and the tongues 299 and 301 at the lower ends of struts 243 extend through the slots 235 and 237. The tongues 271, 293 and 295 at the top are bent over against the top face of the web of the top member and the tongues 275, 277, 299 and 301 are bent over against the bottom face of the bottom member. Tongue 269 is left unbent for securement to the structural member (truss) 49. The tongues may have screw holes (not shown) for screws (not shown) as above described for sections 1 and 101.

The top and bottom members 203 and 205 and the struts 241 and 243 may all be formed of sheet steel of the same gauge, e.g. 20 gauge. It will be understood, however, that the strut, e.g. strut 243 toward the face 201*b* of the section 201 that is to be on the inside in the building as erected and to have dry wall applied thereto may be of thinner gauge, e.g. 25 gauge, than the top and bottom members and struts 241 to make it easier to drive self-tapping sheet metal screws through the dry wall into the flanges 281 of the struts 251 at said inside face.

Figure 14:
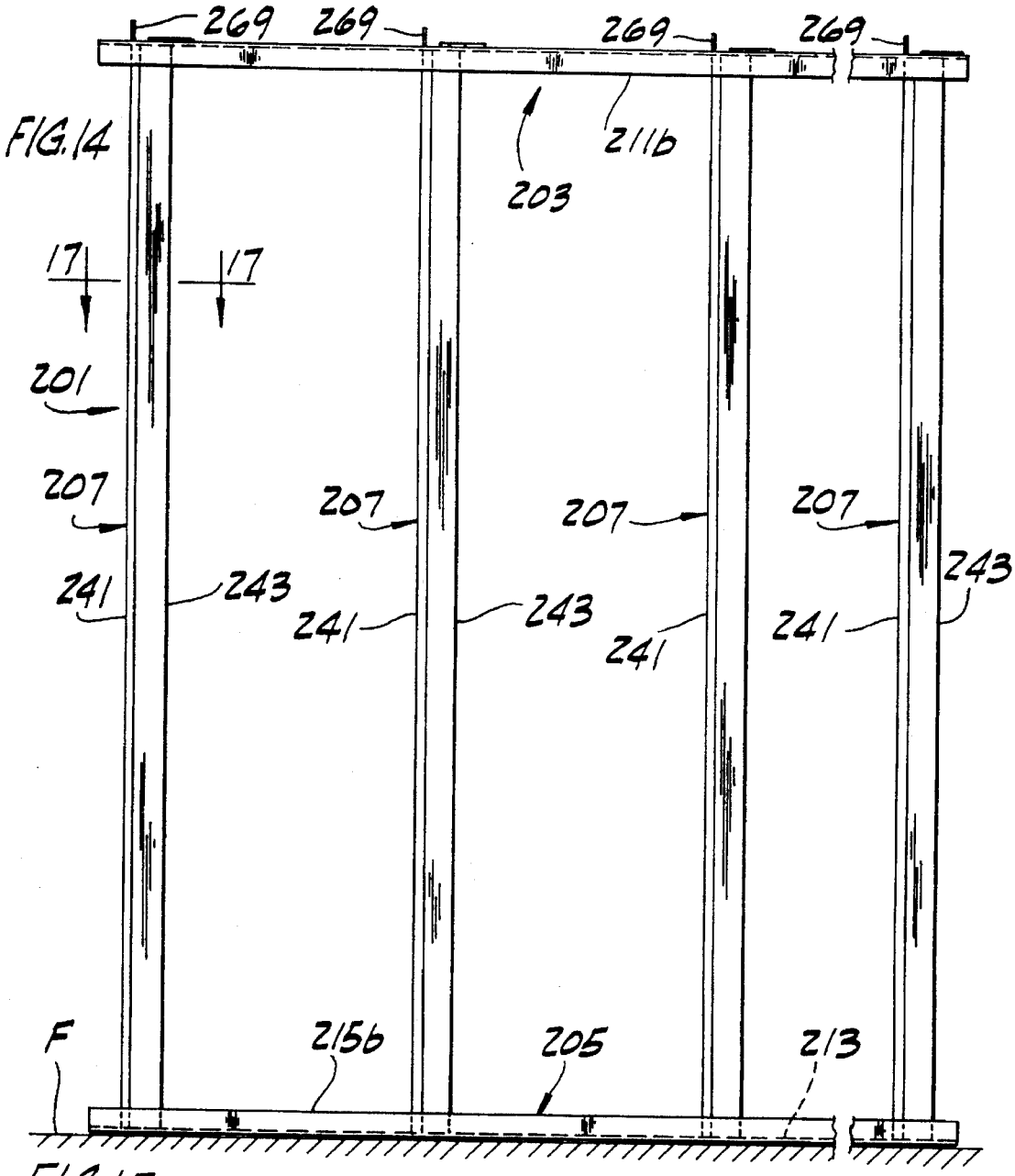
FIG. 14 is a view similar to FIGS. 1 and 8 showing stud means of a third type comprising a double stud.
Figure 15:
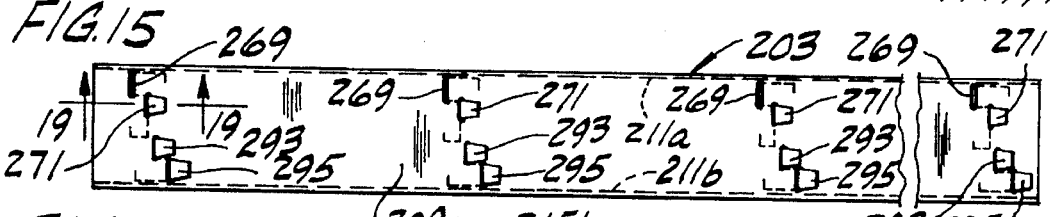
FIG. 15 is a top plan of FIG. 14.
Figure 16:
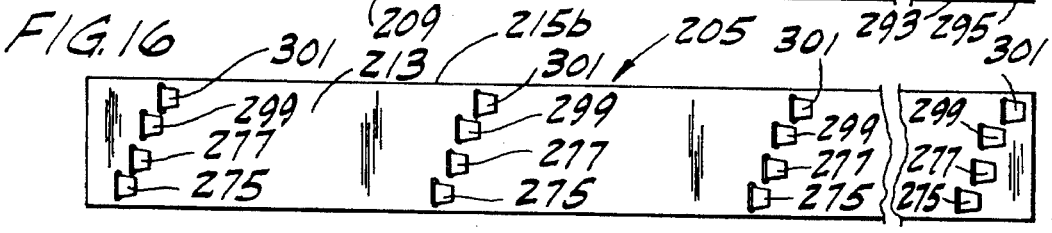
FIG. 16 is a bottom plan of FIG. 14.
Figure 17:
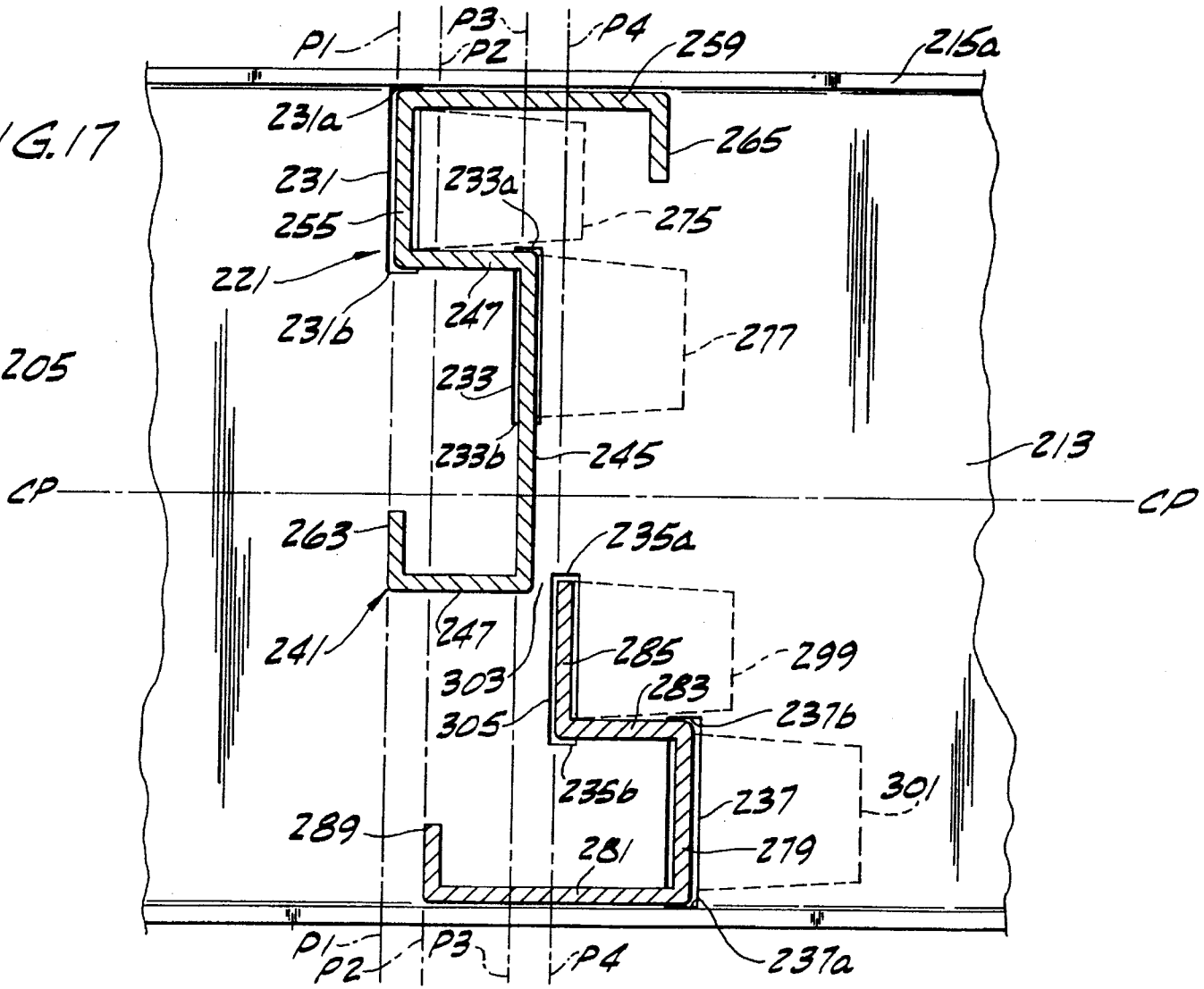
FIG. 17 is an enlarged horizontal section on line 17—17 of FIG. 14.
Figure 18:
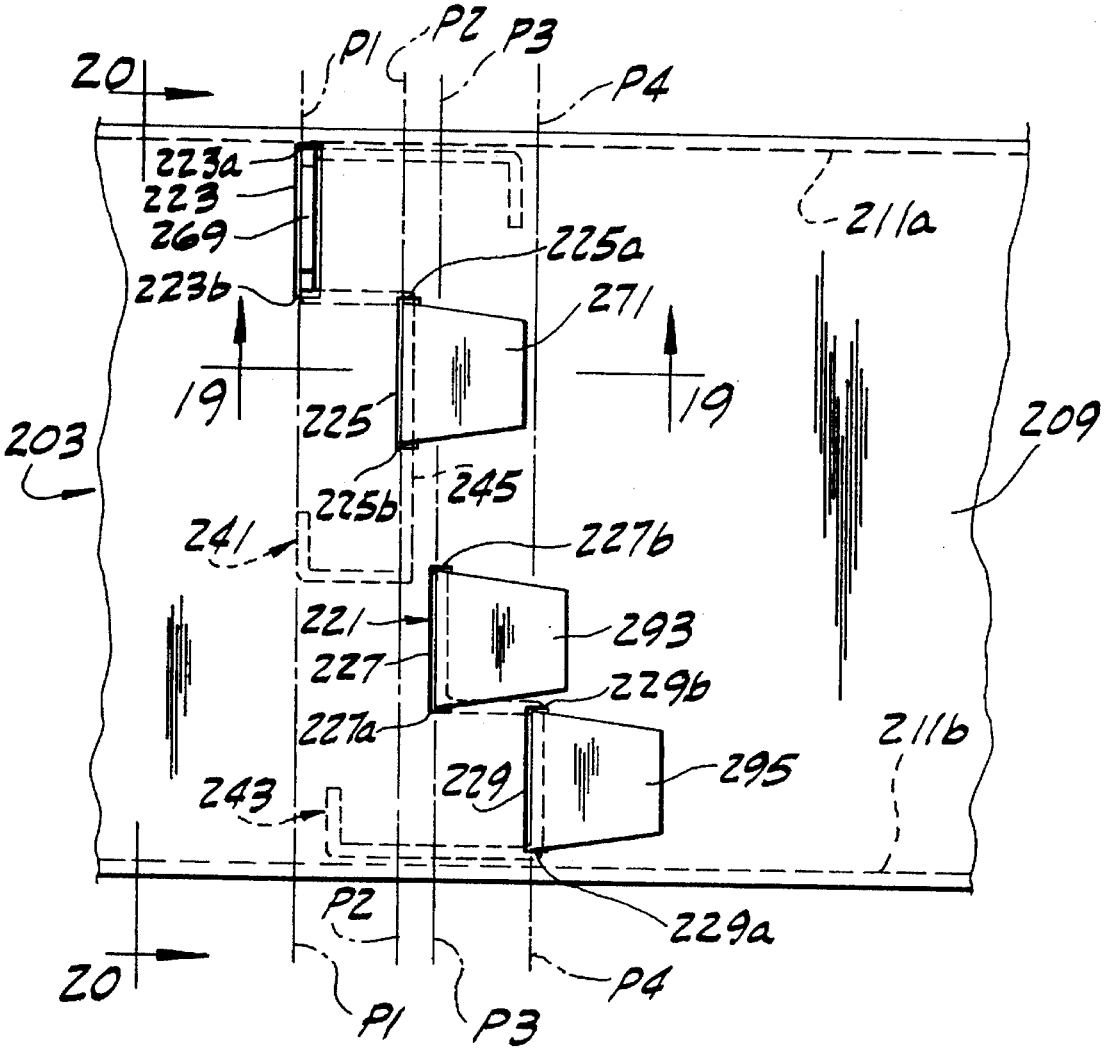
FIG. 18 is an enlarged fragment of FIG. 15.
Figure 19:
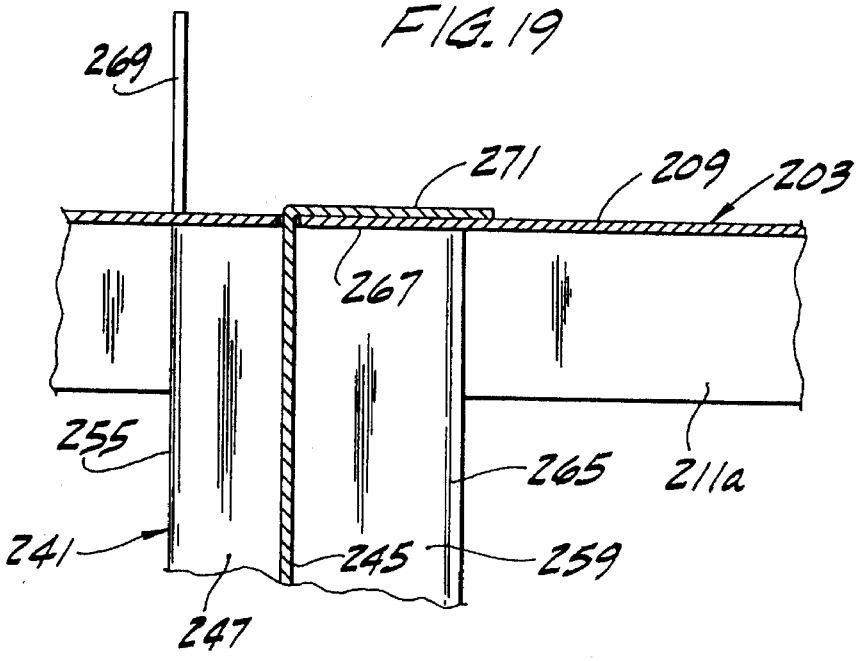
FIG. 19 is an enlarged section on line 19—19 of FIGS. 15 and 18 showing in phantom a roof truss.
Figure 20:
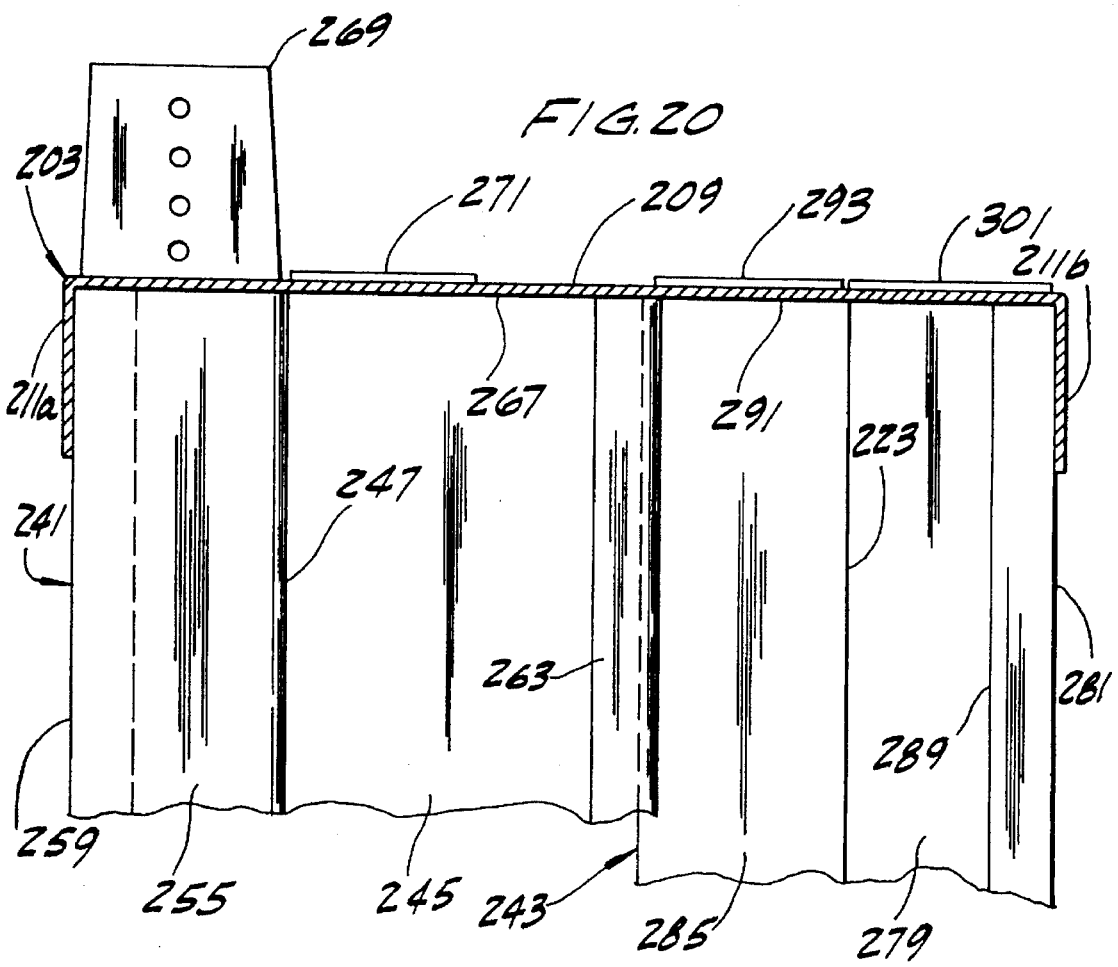
FIG. 20 is a view in section on line 20—20 of FIG. 18.
Figure 24:
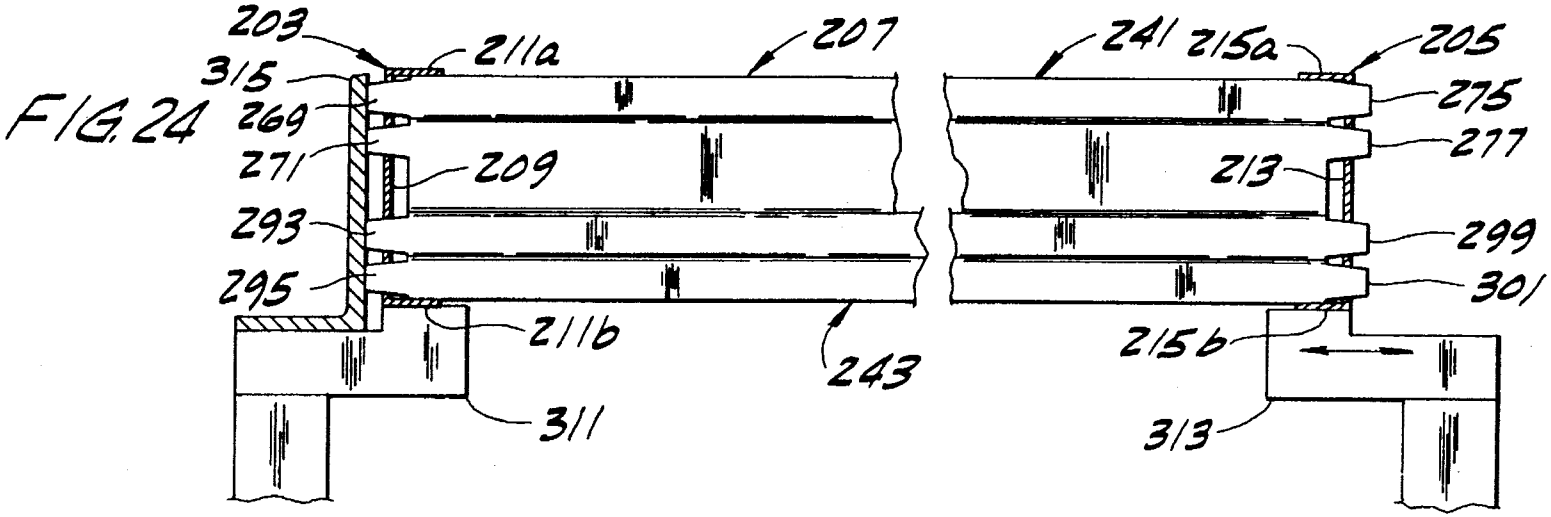
FIGS. 24–26 are views showing a method of this invention for fabricating the framing section of FIG. 14.
Figure 25:
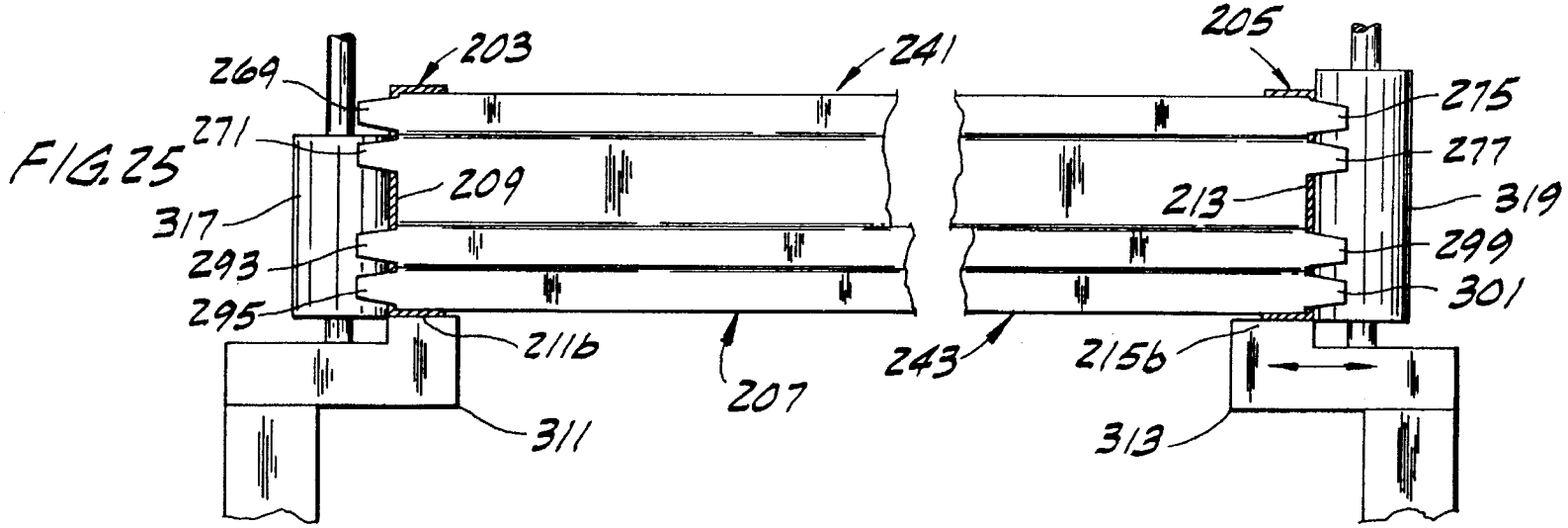
Figure 26:
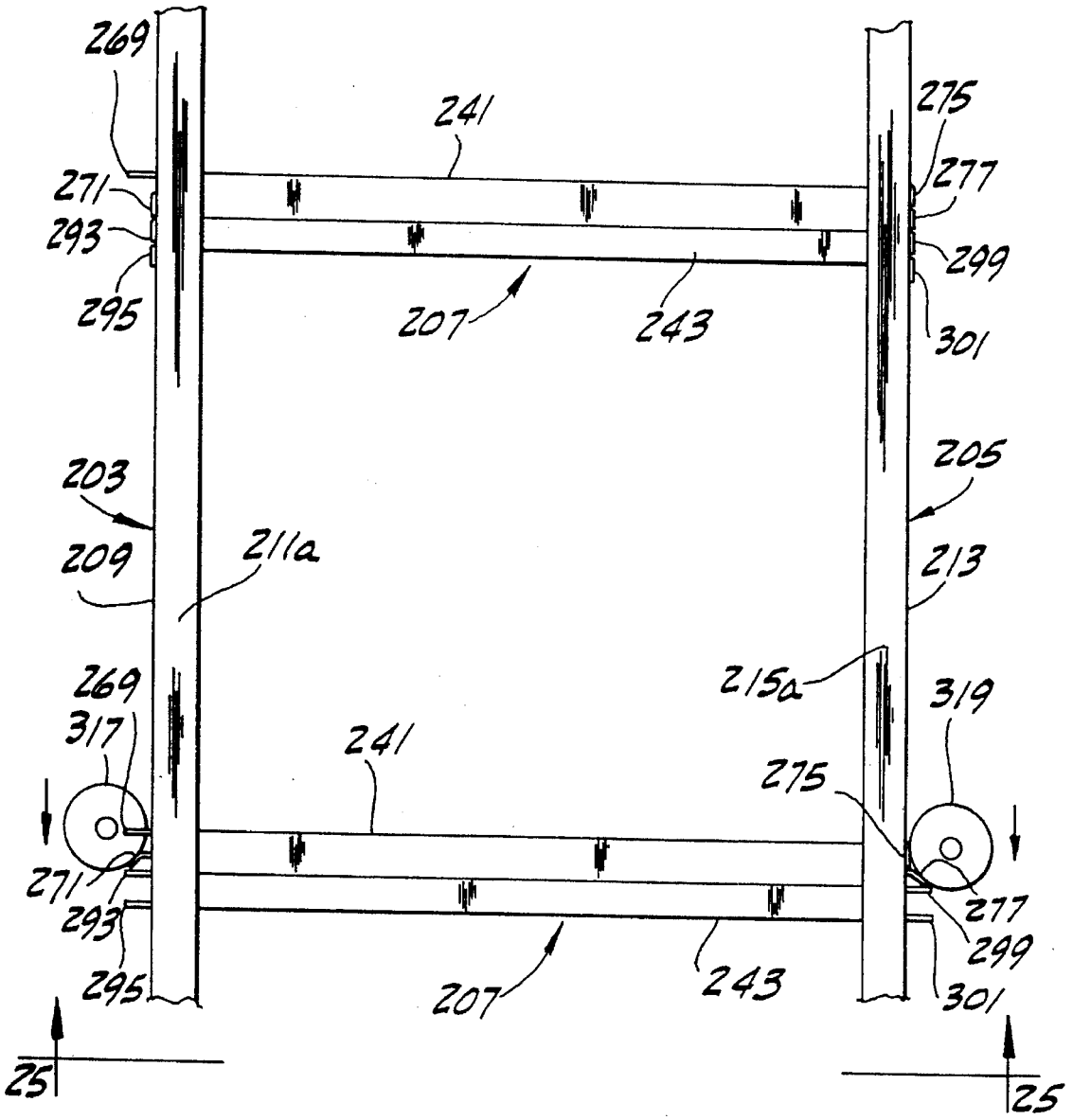

Referring to FIGS. 24–14 26, a method of this invention for fabricating a metal wall framing section of this invention is shown generally to comprise positioning a pair of channels constituting the top and bottom frame members or channels spaced apart approximately the height of the framing section to be fabricated. In FIGS. 24–26, top and bottom channels 203 and 205 for fabricating a section 201 are shown. It will be understood that similar procedure may be followed for section 1 with members 3 and 5 and for a section 101 with members 103 and 105. Following the positioning of the top and bottom channels, a plurality of stud means (207 for a section 201) are positioned extending between them spaced at the stud intervals, with the tongues at the ends of the stud means partially entered in the respective slots in the webs of the respective channels. Thus, as shown in FIG. 24, tongues 269, 271, 293 and 295 at one end of each pair of struts 241 and 251 are partially entered in the respective slots 223, 225, 227 and 229 in the web 209 of channel 203, and tongues 275, 277, 299 and 301 at the other end of each pair of struts 241 and 251 are partially entered in the respective slots 231, 233, 235 and 237 in the web of channel 205. With the tongues entered in the slots, the top and bottom channels are moved relatively toward each other thereby to have the tongues received in the slots, and fully entered therein with the end edges of the stud means engaging the respective faces of the webs of the top and bottom channels (see FIG. 25). Then, the tongues 275, 277, 299 and 301 extending through the slots in the bottom channel 205 are bent over against the bottom face of the web 213 of the bottom channel, and each tongue extending through the slots in the top channel 203, except the tongues 269 which are remain extending outwardly from the top channel, is bent over against the top face of the top channel. The completed section may then be moved from its fabrication position and transported to a location for erection. Before moving it, the bent-over tongues, or some of them, may be fastened by self-tapping sheet metal screws to the top and bottom channels.

In further detail, referring to FIG. 24, the top and bottom channels 203 and 205 may be laid in horizontal position on first and second spaced supports 311 and 313, said channels extending generally parallel to one another and spaced a distance corresponding generally to the length of struts 241 and 251 plus the length of a tongue. The channels are positioned on the supports with the slots of each set of slots in the web of one channel at least generally opposite the slots of that set in the web of the other channel and suitably clamped in that position. Then, working from one end of the section to be fabricated to the other, each stud means 207 comprising a pair of struts 241 and 243 is set in place. This step involves, for example, entering the tongues 299 and 301 of the lower strut 243 of the pair in the slots in the web 213 of the channel 205, pushing the strut endwise in the direction (toward the right as viewed in FIG. 24) fully to enter these tongues in the respective slots thereby to clear the tongues at the other (left) end of the strut for entry in the respective slots in the web 209 of channel 203, then shifting the strut back endwise in the opposite direction to enter the tongues 293 and 295 in the slots 227 and 229 in the web of channel 203. As shown in FIG. 24, a stop 315 is mounted on the support 311 in position for engagement by the ends of the tongues 293 and 295 as the strut 243 is shifted back to prevent the tongues 299 and 301 from being pulled out of the respective slots in the member 205, this stop being so located that the tongues at each end of the strut extend about half their length into the respective slots as appears in FIG. 24. After the lower strut 243 of the pair is so applied, the upper strut 241 is applied in the same manner, and after each pair of struts has been so applied, the next pair is applied in the same manner.

The support 313, with the channel 205 suitably clamped thereto, is movable toward and back away from the other support 311 as indicated by the arrows in FIGS. 24 and 25. After all the struts have been assembled with the top and bottom channels as shown in FIG. 24, the stop 315 is removed and the support 313 with the channel 205 clamped thereon is moved in the direction toward the outer support (toward the left as illustrated) to the point where the end edges of the struts at channel 203 engage the inside face (the bottom face) of the web of this channel and the opposite end edges of the struts are engaged by the inside face (the top face) of the web of channel 205, as shown in FIG. 25. This readies the assembly for bending over of the tongues 271, 293, 295, 275, 277, 299, 301, which is accomplished as illustrated in FIGS. 25 and 26 and moving a first bending tool 317 along the outside of the web 209 of the channel 203 and a second bending tool 319 along the outside of the web of the channel 205. Each of the bending tools may comprise a roller which is rolled along lengthwise of its respective channel 203, 205 along the outside of the web thereof. The first roller 317, which is rolled along the outside of the web 209 of channel 203, is of such length (height) as to engage and bend over tongues 271, 293 and 295 but to be clear of and thereby miss tongues 269 so as to leave them unbent. The second roller 319, which is rolled along the outside of the web 213 of channel 205, is longer (higher) than roller 317 and functions to bend over all the tongues 275, 277, 299 and 301, Then the channels 203 and 205 may be unclamped from the supports 311 and 313 and the completed framing section 201 removed, It is contemplated that the bending rollers 317 and 319 may be held in fixed position and the supports 311 and 313 with the channels 203 and 205 clamped thereto moved endwise for the bending of the tongues, instead of holding the supports stationary and moving the rollers. It will be observed that the aforesaid method of fabricating a wall framing section does not involve any extensive layout procedure; with the slots in the top and bottom members, the location of the struts is pre-established. And it will be further observed that no turn-over of the section is involved.

In view of the above, it will be seen that the several objects of the invention are achieved and other advantageous results attained.

As various changes could be made in the above constructions and methods without departing from the scope of the invention, it is intended that all matter contained in the above description or shown in the accompanying drawings shall be interpreted as illustrative and not in a limiting sense.

What is claimed is:

1. A metal wall framing section comprising spaced apart elongate top end bottom members end a plurality of parallel elongate stud means formed of sheet metal extending between the top and bottom members spaced at intervals along the lengths of said members, each of said members being formed of sheet metal having a web end means for stiffening the web, the web of the bottom member being generally horizontal at the bottom of the section in the erected position of the section, each stud means comprising at least one strut extending generally vertically between the webs of said members in the erected position of the framing section, the webs of the top end bottom members having sets of slots spaced at said intervals, each set at each interval comprising at least one pair of slots in the web of the top member extending transversely with respect to the top member end at least one slot in the web of the bottom member extending transversely with respect to the bottom member, each strut having en end edge at one end constituting its upper end generally engaging the bottom face of the web of the top member and having a pair of tongues integral therewith extending from said upper end edge through the slots of the respective set of slots in the top member, said strut having an end edge at its other end constituting its lower end generally engaging the top face of the web of the bottom member and having a tongue integral therewith extending through the slot of the respective set of slots in the bottom member, the tongue at the lower end of each strut being bent over against the bottom face of the web of the bottom member, one of the tongues at the upper end of each strut being bent over against the top face of the web of the top member, and the other tongue at the upper end of each strut extending upwardly from the web of the top member for securement thereto of structure subsequently applied to the top member.

2. A metal wall framing section as set forth in claim 1 wherein each strut has a second tongue integral therewith extending from the lower end thereof through a second transverse slot in the web of the bottom member and bent over like the first-mentioned tongue at the lower end of the stud means.

3. A metal wall framing section as set forth in claim 2 which further includes fastening means securing the bent-over tongues to the top and bottom members.

4. A sheet metal wall framing section as set forth in claim 2 wherein each strut has a C-shaped cross section at least in part.

5. A metal wall framing section as set forth in claim 4 wherein each said strut is formed with such a share in cross-section as to have a web which extends in a vertical plane transverse to the top and bottom members and first and second flanges extending at right angles to the web in one direction from the longitudinal edges of the web, the tongues at each end of the stud means extending from the web.

6. A metal wall framing section as set forth in claim 5 wherein the web of the strut has a width corresponding generally to the width of the webs of the top and bottom members and the flanges of the strut extend longitudinally in one direction with respect to the top and bottom members generally in planes defining faces of the section, the flanges at each face being adapted for fastening thereto of cladding subsequently applied to said faces of the section.

7. A metal wall framing section as set forth in claim 1 wherein each stud means comprises a pair of elongate struts, the first strut of each pair being formed with such a shape in cross section as to have a web extending in a vertical plane transverse to the top and bottom members and a flange extending at right angles to the web longitudinally in one direction from a longitudinal edge of the web and being located in a plane defining one face of the section, the second strut of each pair being juxtaposed with the first strut transversely with respect to the top and bottom members and being formed with such a shape in cross section as to have a web extending in a vertical plane transverse to the top and bottom members and a flange extending at right angles to the web from a longitudinal edge of the web and located opposite the flange of the first strut in a plane defining the other face of the section, the flanges at each face of the section being adapted for fastening cladding subsequently applied to the faces of the section, each strut having at least one tongue at each end extending through transverse slots in the webs of the top and bottom member, one of the tongues at the upper ends of the struts being bent over against the top face of the top member, and another of the tongues at the upper ends of the studs extending longitudinally with respect to the studs and being received in a transverse slot in the top member and remaining unbent for securement to a structural member supported by the framing section, the tongues at the lower end of the struts being bent over against the bottom face of the bottom member.

8. A metal wall framing section as set forth in claim 7 wherein the first and second struts are spaced one from the other to provide a thermal break between the two struts.

9. A metal wall framing section as set forth in claim 8 wherein one strut of each pair is of metal lighter in gauge than that of the other strut of the pair.

10. A metal wall framing section as set forth in claim 8 wherein the struts are generally C-shaped in cross section and open in opposite directions.

11. A metal wall framing section as set forth in claim 8 wherein each of said first struts is formed with such a shape in cross-section as to have a first web which extends in a vertical plane transverse to the top and bottom members, first and second flanges extending at right angles to said first web in one direction from the longitudinal edges of the web, a second web extending laterally outwardly from the outer longitudinal edge of the second flange, and a third flange extending back at right angles to the second web from the outer longitudinal edge of the second web, the tongues at each end of the first strut extending from the first and second webs.

12. A metal wall framing section as set forth in claim 11 wherein the third flange of the first strut is located in a plane defining one face of the section and is adapted for fastening thereto of cladding subsequently applied to said face of the section.

13. A metal framing section as set forth in claim 8 wherein each of said second struts is formed with such a shape in cross section as to have a first web which extends in a vertical plane transverse to the top and bottom members, first and second flanges extending at right angles to said first web in one direction from said first web, and a second web extending laterally outwardly from the outer longitudinal edge of the second flange, the tongues at each end of the second strut extending from the first and second webs.

14. A metal framing section as set forth in claim 13 wherein the first flange of the second strut is located in a plane defining one face of the section for fastening thereto of cladding subsequently applied to said face of the section.

15. A metal wall framing section as set forth in claim 8 wherein each of said first struts is formed with such a shape in cross-section as to have a first web which extends in a vertical plane transverse to the top and bottom members, first and second flanges extending at right angles to said first web in one direction from the longitudinal edges of the web, a second web extending laterally outwardly from the outer longitudinal edge of the second flange, and a third flange extending back at right angles to the second web from the outer longitudinal edge of the second web, the tongues at each end of the first strut extending from the first and second webs thereof, each second strut is formed with such a shape in cross-section as to have a first web which extends in a vertical plane transverse to the top and bottom members, first and second flanges extending at right angles to said first web in one direction from said first web, and a second web extending laterally outwardly from the outer longitudinal edge of the second flange, the tongues at each end of the second strut extending from the first and second webs thereof, the said third flange of the first strut being located in a plane defining one face of the section and the first flange of the second strut being located in a plane defining the other face of the section, the said third and first flanges being adapted for fastening thereto of cladding subsequently applied to said faces of the section.

16. A metal framing section as set forth in claim 15 wherein the other longitudinal edge of each second strut is adjacent to but spaced from the juncture of the first web and the first flange of the respective first strut to provide the said thermal break.

17. A metal wall framing section as set forth in claim 8 wherein each of the first and second struts is formed of channel shape in cross-section having a web and flanges extending in one direction from the longitudinal edges of the web, the width of the web of each of the first and second struts being less than the width of the webs of the top and bottom members, the first and second struts facing in opposite directions with respect to the length of the top and bottom members with a first flange of the first strut extending in one direction between the flanges of the second strut and with its second flange in a plane defining one face of the section and with a second flange of the second section extending in the opposite directions between the flanges of the first strut and with its first flange in a plane defining the other face of the section.

18. An elongate sheet metal strut for stud means for a wall framing section having spaced apart sheet metal top and bottom members, the strut being adapted to span and interconnect said members, the strut having one end constituting its upper end and another end constituting its lower end, the strut being formed with such a shape in cross section as to have web means and flange means, at least one tongue integrally formed with and extending longitudinally and transversely with respect to the strut coplanar with the web means from each end thereof, the tongues being adapted to be received in slots formed in said upper and lower members extending transversely with respect to said members and to be bent over against outer surfaces of the respective members, and an additional tongue integrally formed from the strut extending longitudinally with respect to said strut at its upper end coplanar with the web means and adapted to be received in a slot in the top member extending transversely with respect to the top member and to remain unbent for securement to a structural member supported by the framing section, said strut being formed with such a shape in cross-section as to have a first web which extends in a vertical plane transverse to the top and bottom members, first and second flanges extending at right angles to said first web in one direction from the longitudinal edges of the web, a second web extending laterally outwardly from the outer longitudinal edge of the second flange, the first and second webs constituting the web means, and a third flange extending back at right angles to the second web from the outer longitudinal edge of the second web in the opposite direction and integrally joined to the second web at a bend of said outer longitudinal edge of the second web, the tongues at each end of the strut extending from the first and second webs, each tongue being coplanar with its respective web.

19. An elongate sheet metal strut for stud means for a wall framing section having spaced apart sheet metal top and bottom members, the strut being adapted to span and interconnect said members, the strut having one end constituting its upper end and another end constituting its lower end, the strut being formed with such a shape in cross section as to have web means and flange means, at least one tongue integrally formed with and extending longitudinally and transversely with respect to the strut coplanar with the web means from each end thereof, the tongues being adapted to be received in slots formed in said upper and lower members extending transversely with respect to said members and to be bent over against outer surfaces of the respective members, and an additional tongue integrally formed from the strut extending longitudinally with respect to said strut at its upper end coplanar with the web means and adapted to be received in a slot in the top member extending transversely with respect to the top member and to remain unbent for securement to a structural member supported by the framing section said strut being formed with such a shape in cross section as to have a first web which extends in a vertical plane transverse to the top and bottom members, first and second flanges extending at right angles to said first web in one direction from said first web, and a second web extending laterally outwardly from the outer longitudinal edge of the second flange, the first and second webs constituting the web means, the second web having a free outer edge the tongues at each end of the strut extending from the first and second webs, each tongue being coplanar with its respective web.

20. A method of fabricating a wall framing section comprising opposed spaced apart elongate top and bottom members and parallel stud means formed of sheet metal extending between the top and bottom members and spaced at intervals along the lengths of said members comprising:

positioning a pair of top and bottom frame members spaced apart approximately the height of the framing section to be fabricated, each member having transverse slots spaced at said intervals;

positioning a plurality of stud means between said members spaced at said intervals, said stud means having at least one tongue at each end integral therewith and extending longitudinally therefrom and an additional tongue integral therewith and extending longitudinally from the end thereof toward the top member;

moving the top and bottom members relatively toward each other thereby to have the tongues of the stud means received in said transverse slots;

bending the tongues extending through the slots in the bottom member against the bottom face of the bottom member;

bending one tongue extending from the stud means through a respective slot of the top member against the top face of the top member while leaving the additional tongue extending outwardly from the top member for securement thereto of the structure subsequently applied to the top member whereby the wall framing section may be moved from its said position and transported to a location for erection.

21. A method of fabricating a metal framing section as set forth in claim 20 further comprises securing the bent over tongues to the top and bottom framing members by fastening means prior to moving the framing section.

22. The method of claim 20 wherein each of the top and bottom frame members comprises a channel having a web and flanges, the transverse slots being in the webs of the channels, the webs of the channels being spaced apart a distance corresponding generally to the length of the stud means plus the length of a tongue, and wherein each stud means is assembled with the top and bottom frame members by entering the tongues at one end of the stud means in the respective slots in the web of one of the channels, pushing the stud means endwise in the direction toward said one channel to clear the tongues at the other end of the stud means for entry in the other channel, then shifting the stud means back to partially enter the tongues at said other end of the stud means in the slots in the web of said other channel, moving said channels relatively one toward the other to complete the entry of the tongues in the slots, and then bending over the tongues to be bent.

23. The method of claim 22 wherein the shifting back of the stud means is against a stop to prevent the tongues in the slots of said one channel from being pulled out of these slots.

24. The method of claim 23 wherein the bending over of the tongues is effected, after withdrawal of the stop, by relative movement of first and second bending tools and the assembly of the channels and the stud means.

25. The method of claim 24 wherein the first bending tool is formed to clear the tongues which are to remain unbent.

26. The method of claim 24 wherein the bending tools are rollers which are rolled over the outside of the webs of the channels.

27. The method of claim 24 wherein the bending tools are rollers, the second being of such length as to bend over all the tongues at one end of the stud means and the first being shorter and of such length as to bend over all the tongues at the other end of the stud means except the one which is to remain unbent.

* * * * *